US010621806B2

(12) United States Patent
Fujio et al.

(10) Patent No.: US 10,621,806 B2
(45) Date of Patent: Apr. 14, 2020

(54) COIN HANDLING APPARATUS

(71) Applicant: GLORY LTD., Hyogo (JP)

(72) Inventors: Yuji Fujio, Hyogo (JP); Masato Takeuchi, Hyogo (JP); Yoshikatsu Oota, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/988,201

(22) Filed: May 24, 2018

(65) Prior Publication Data

US 2018/0342125 A1 Nov. 29, 2018

(30) Foreign Application Priority Data

May 24, 2017 (JP) ..... 2017-103078

(51) Int. Cl.

| | |
|---|---|
| ***G07D 9/00*** | (2006.01) |
| ***G07D 3/12*** | (2006.01) |
| ***G07D 1/02*** | (2006.01) |
| ***G07D 3/14*** | (2006.01) |

(52) U.S. Cl.

CPC ..... *G07D 9/008* (2013.01); *G07D 1/02* (2013.01); *G07D 3/125* (2013.01); *G07D 3/14* (2013.01); *G07D 2201/00* (2013.01)

(58) Field of Classification Search

CPC ..... G07D 1/02; G07D 3/125; G07D 3/14; G07D 9/008; G07D 2201/00

See application file for complete search history.

(56) References Cited

U.S. PATENT DOCUMENTS

| | | | | |
|---|---|---|---|---|
| 2006/0183418 | A1* | 8/2006 | Umeda | G07D 1/02 453/12 |
| 2009/0047888 | A1* | 2/2009 | Nishida | G07D 1/00 453/3 |
| 2014/0001198 | A1* | 1/2014 | Nagoya | G07D 9/008 221/92 |
| 2014/0295745 | A1* | 10/2014 | Karlsson | G07D 3/06 453/13 |
| 2016/0240028 | A1* | 8/2016 | Onishi | G07D 3/128 |

FOREIGN PATENT DOCUMENTS

| | | | |
|---|---|---|---|
| EP | 2842891 | A1 | 3/2015 |
| JP | 2015-049700 | A | 3/2015 |
| WO | 2012/115019 | A1 | 8/2012 |

OTHER PUBLICATIONS

Extended European Search Report for EP18173800.6 dated Oct. 29, 2018, (47 pages).

* cited by examiner

*Primary Examiner* — Mark J Beauchaine
(74) *Attorney, Agent, or Firm* — Brundidge & Stanger, P.C.

(57) ABSTRACT

A coin handling apparatus capable of appropriately feeding coins is provided. A coin handling apparatus includes a plurality of storing units each including an inclining disk rotated in an inclining attitude in which the inclining disk inclines by a predetermined angle with respect to a vertical direction and a transport unit that transports coins. The storing units form a plurality of rows along the transport unit, and the rows each include a plurality of the storing units and are each disposed so that surfaces of adjacent inclining disks in the row face each other.

17 Claims, 12 Drawing Sheets

COIN HANDLING APPARATUS

CROSS REFERENCE TO RELATED APPLICATIONS

The disclosure of Japanese Patent Application No. 2017-103078 filed on May 24, 2017 including the specification, drawings and abstract is incorporated herein by reference in its entirety.

TECHNICAL FIELD

The present invention relates to a coin handling apparatus.

BACKGROUND ART

Conventionally, as an apparatus that deposits and withdraws coins, there are known coin handling apparatuses, such as a register change apparatus and a money changer. As an example of such a coin handling apparatus, there is a disclosed coin handling apparatus having coin dispensers arranged in rows on opposite sides of a transport belt that travels toward a coin pickup port (see PTL 1, for example). The coin dispensers arranged in the rows are so disposed that the surfaces of rotary disks sandwich the transport belt and face each other, as disclosed in FIG. 6 of PTL 1.

CITATION LIST

Patent Literature

PTL 1
Japanese Patent Application Laid-Open No. 2015-049700

SUMMARY OF INVENTION

Technical Problem

In PTL 1 described above, however, coins selected by a selector drops in the vicinity of an ejector that dispenses coins (feeding exit), and coins could undesirably stack in the vicinity of the feeding exit. When coins stack in the vicinity of the feeding exit, the coin dispensers cannot undesirably feed coins appropriately.

An object of the present invention is to provide a coin handling apparatus capable of appropriately feeding coins.

Solution to Problem

A coin handling apparatus according to the present invention includes a plurality of storing units, each of which comprising an inclining disk that is rotatable about an axis that is inclined by a predetermined angle with respect to a horizontal direction; and a transport unit that transports coins, in which the plurality of storing units are disposed to form a plurality of rows along the transport unit, and each of the plurality of rows comprises two or more storing units, and the plurality of the storing units are disposed so that surfaces of the inclining disks adjacent to each other in each of the plurality of rows face each other.

Advantageous Effects of Invention

The coin handling apparatus according to the present invention can appropriately feed coins.

DESCRIPTION OF EMBODIMENTS

Embodiments of the present invention will be described below with reference to the accompanying drawings.

Embodiment 1

Figure 1:
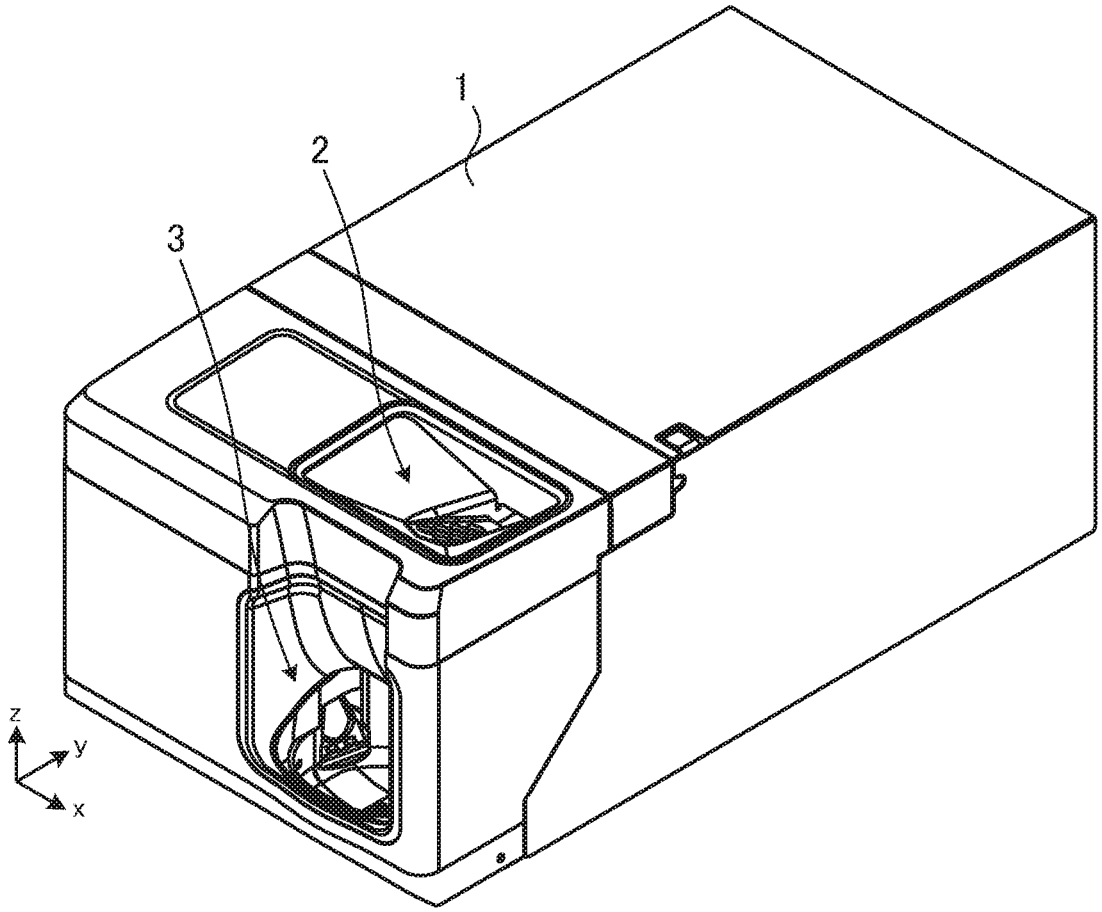
FIG. 1 is a perspective view showing an example of a coin handling apparatus according to Embodiment 1.

FIG. 1 is a perspective view showing an example of a coin handling apparatus 1 according to Embodiment 1. The coin handling apparatus 1 includes an inlet 2 and an outlet 3, as shown in FIG. 1. The coin handling apparatus 1, for example, stores coins paid at a register or feeds stored coins as changes. In the following description, a three-axis coordinate system, such as that shown in FIG. 1, is set in relation to the coin handling apparatus 1.

The inlet 2 is provided in a front upper surface of the apparatus. Coins to be deposited in the coin handling apparatus 1 are put into the inlet 2. The coins put into the inlet 2 are stored in the coin handling apparatus 1.

The outlet 3 is provided in the front surface of the apparatus and below the inlet 2. Coins stored in the coin handling apparatus 1 are withdrawn to the outlet 3. Coins rejected at the time of deposit are withdrawn to the outlet 3.

Figure 2:
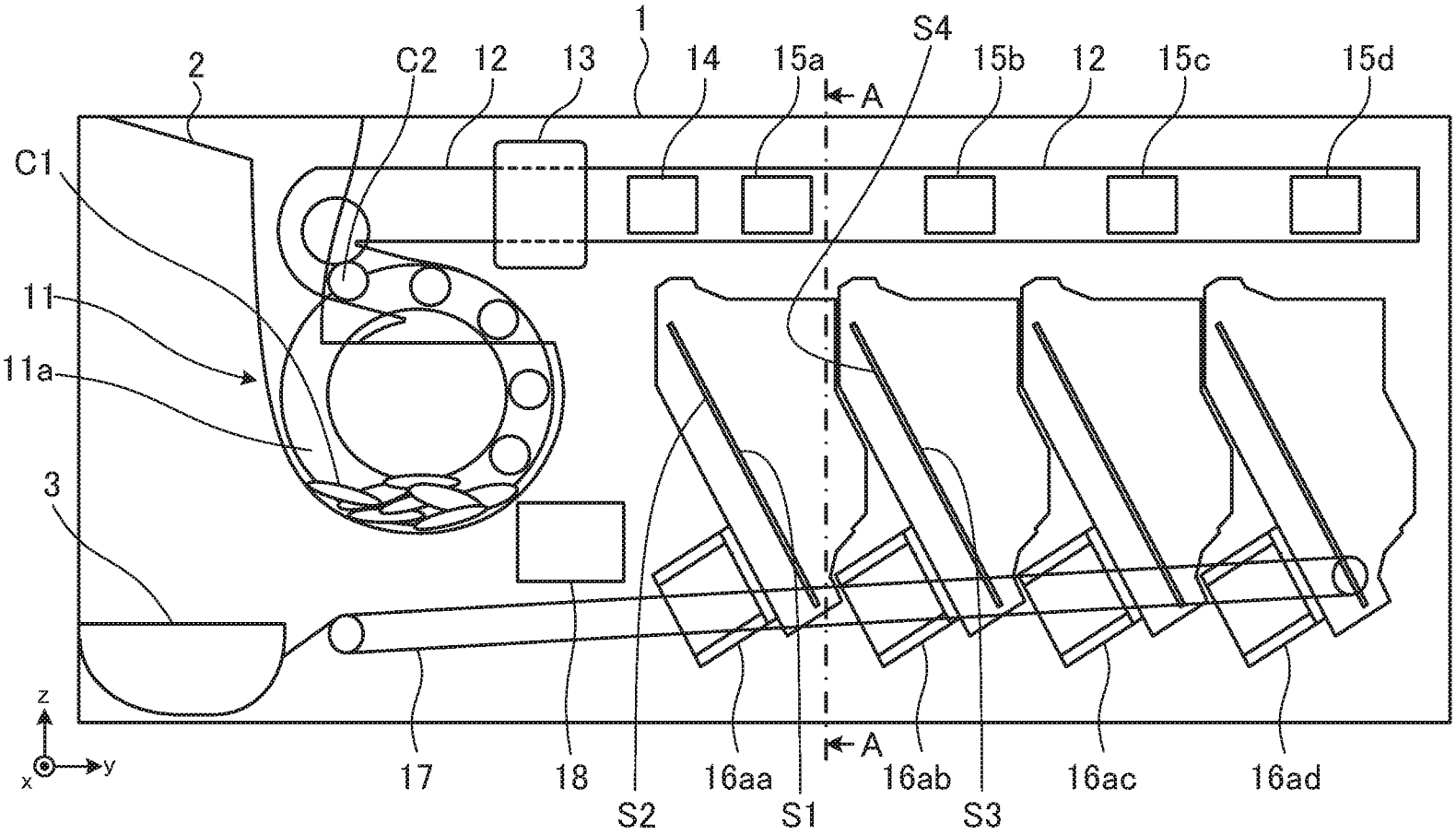
FIG. 2 is a side cross-sectional view of the coin handling apparatus.

FIG. 2 is a side cross-sectional view of the coin handling apparatus 1. The coin handling apparatus 1 shown in FIG. 2 is a simplified version of the coin handling apparatus 1 shown in FIG. 1 in terms of the shape and other factors. In FIG. 2, the same portions as those in FIG. 1 have the same reference characters.

The coin handling apparatus 1 includes an accumulation feeder 11, a transport unit (second transport unit) 12, an identifying unit 13, coin diverters 14 and 15*a* to 15*d*, storing/feeding units (storing units) 16*aa* to 16*ad*, a withdrawal transport unit (first transport unit) 17, and a collection box 18, as shown in FIG. 2.

Coins put into the inlet 2 travel along a chute and drop into the accumulation feeder 11. The accumulation feeder 11 temporarily accumulates the coins put into the inlet 2. Coins C1 shown in FIG. 2 represent coins temporarily accumulated in a hopper of the accumulation feeder 11.

The accumulation feeder 11 includes an inclining disk 11*a*. The inclining disk 11*a*, along with the hopper, forms a space that stores coins. The inclining disk 11*a* has coin catching protrusions (not shown) on the front surface thereof. The accumulation feeder 11 rotates the inclining disk 11*a* (counterclockwise in FIG. 2, for example) to allow the protrusions on the front surface thereof to catch the temporarily accumulated coins C1 and pick them up. The accumulation feeder 11 then feeds the coins C1 picked up by the inclining disk 11*a* onto the transport unit 12. A coin C2 shown in FIG. 2 represents a coin being fed by the inclining disk 11*a* to the transport unit 12.

The transport unit 12 is provided immediately below the upper surface of the coin handling apparatus 1. The transport unit 12 is provided roughly at the center in the x-axis direction when viewed from the side facing the front surface or the rear surface of the apparatus (see FIG. 3 or 4, for example).

The transport unit 12 extends from the front side toward the rear side of the apparatus. The transport unit 12 transports the coins fed from the accumulation feeder 11 from the front side toward the rear side of the apparatus. The transport unit 12 can, for example, be based on a typical technology for transporting coins on a transport belt.

The identifying unit 13 is provided on the downstream side of the accumulation feeder 11 but on the upstream side of the coin diverters 14 and 15*a* to 15*d* and on the transport unit 12. The identifying unit 13 identifies the coins fed from the accumulation feeder 11. For example, the identifying unit 13 includes a variety of sensors, such as a magnetism sensor, and identifies the denomination of a coin transported by the transport unit 12 to be, for example, an accepted coin, a rejected coin, or a collected coin (counterfeit coin, for example).

The coin diverter 14 diverts the coins transported by the transport unit 12 in three directions. For example, the coin diverter 14 diverts the coins transported by the transport unit 12 in a downstream transport direction (direction in which coins are directly transported by transport unit 12 (+y-axis direction)), the direction leading to the withdrawal transport unit 17, and the direction leading to the collection box 18.

The coin diverter 14 diverts the coins transported by the transport unit 12 in the three directions in accordance with the result of the identification performed by the identifying unit 13. For example, the coin diverter 14 diverts a coin identified by the identifying unit 13 to be a rejected coin in the direction leading to the withdrawal transport unit 17. A rejected coin includes a coin of a denomination that cannot be accepted as a deposited coin, a coin of a denomination that has not been successfully identified, and a counterfeit coin or a coin suspected thereof. The coin diverter 14 diverts coins having been identified by the identifying unit 13 to be collected coins in the direction leading to the collection box 18. A collected coin includes a coin of a denomination accepted as a deposited coin but not used as a withdrawn coin. Among rejected coins, counterfeit coins or coins suspected thereof may be stored in the collection box 18. The coin diverter 14 diverts coins which have been identified by the identifying unit 13 not to be rejected coins or collected coins and the denomination of which has been determined in the downstream transport direction.

The coin diverters 15*a* to 15*d* each divert the coins transported by the transport unit 12 in three directions. For example, the coin diverters 15*a* to 15*d* each divert the coins transported by the transport unit 12 in the downstream transport direction (+y-axis direction), in the direction leading to the storing/feeding units 16*aa* to 16*ad*, and the direction leading to four storing/feeding units (see FIG. 3 or 4, for example) so provided as to face the storing/feeding units 16*aa* to 16*ad* via the transport unit 12.

The coin diverters 15*a* to 15*d* each divert the coins transported by the transport unit 12 in the three directions in accordance with the result of the identification performed by the identifying unit 13. For example, the coin diverter 15*a* diverts a coin having been identified by the identifying unit 13 to be a coin of a first denomination in the direction leading to the storing/feeding unit 16*aa* (see arrow A2 in FIG. 3, for example). The coin diverter 15*a* diverts a coin having been identified by the identifying unit 13 to be a coin of a second denomination in the direction leading to the storing/feeding unit so provided as to face the storing/feeding unit 16*aa* via the transport unit 12 (see arrow A3 in FIG. 3, for example). The coin diverter 15*a* diverts a coin having been identified by the identifying unit 13 to be a coin of a denomination other than the first and second denominations in the downstream transport direction (+y-axis direction in FIG. 3, for example).

The coin diverter 15*b* diverts a coin having been identified by the identifying unit 13 to be a coin of a third denomination in the direction leading to the storing/feeding unit 16*ab*. The coin diverter 15*b* diverts a coin having been identified by the identifying unit 13 to be a coin of a fourth denomination in the direction leading to the storing/feeding unit so provided as to face the storing/feeding unit 16*ab* via the transport unit 12. The coin diverter 15*b* diverts a coin having been identified by the identifying unit 13 to be a coin of a denomination other than the first to fourth denominations in the downstream transport direction.

The coin diverter 15*c* also diverts the coins transported by the transport unit 12 in three directions, as do the coin diverters 15*a* and 15*b*. The coin diverter 15*d* diverts the coins in two directions because there is no apparatus on the downstream side of the transport unit 12. For example, the coin diverter 15*d* diverts the coins transported by the transport unit 12 in the following two directions; the direction leading to the storing/feeding unit 16*ad*; and the direction leading to the storing/feeding unit so provided as to face the storing/feeding unit 16*ad* via the transport unit 12.

The storing/feeding units 16*aa* to 16*ad* each store the coins transported by the transport unit 12 in a hopper. The coins transported by the transport unit 12 are diverted (sorted) by the coin diverters 15*a* to 15*d* in accordance with the result of the identification performed by the identifying unit 13, as described above. The storing/feeding units 16*aa* to 16*ad* can each thus store coins on a denomination basis.

The coin handling apparatus 1 includes the four storing/feeding units that face the storing/feeding units 16*aa* to 16*ad* via the transport unit 12, as will be described later. The coin handling apparatus 1 can therefore store coins of eight denominations at the maximum.

At the time of withdrawal, the storing/feeding units 16*aa* to 16*ad* (including storing/feeding units so provided as to face storing/feeding units 16*aa* to 16*ad* via transport unit 12) each feed stored coins onto the withdrawal transport unit 17. The storing/feeding units 16*aa* to 16*ad* each have an inclining disk having coin catching protrusions provided on the surface thereof. The storing/feeding units 16*aa* to 16*ad* each rotate the inclining disk to allow the protrusions on the front surface thereof to catch coins and pick the coins up. The storing/feeding units 16*aa* to 16*ad* each feed the coins picked up by the inclining disk via a feeding exit and drop the coins onto the withdrawal transport unit 17 (see arrow A1 in FIG. 3, for example).

The storing/feeding units 16*aa* to 16*ad* can, for example, each be the storing/feeding unit disclosed in Japanese Patent Application Laid-Open No. 2012-174035. The storing/feeding unit disclosed in Japanese Patent Application Laid-Open No. 2012-174035 includes an inclining disk rotated in an inclining attitude inclining with respect to the vertical direction by a predetermined angle. Protrusions for picking coins up are formed on the inclining disk. The storing/feeding units 16*aa* to 16*ad* can instead, for example, each be the coin dispenser disclosed in Japanese Patent Application Laid-Open No. 2015-49700. The coin dispenser disclosed in Japanese Patent Application Laid-Open No. 2015-49700 includes an inclining disk rotated in an inclining attitude inclining with respect to the vertical direction by a predetermined angle. Holes for picking coins up are formed in the inclining disk.

The withdrawal transport unit 17 is provided below the transport unit 12 and above the bottom surface of the coin handling apparatus 1. The withdrawal transport unit 17 extends from the front side toward the rear side of the apparatus. Rejected coins diverted by the coin diverter 14 are dropped onto the withdrawal transport unit 17. Coins fed from the storing/feeding units 16*aa* to 16*ad* (including storing/feeding units so provided as to face storing/feeding units 16*aa* to 16*ad* via transport unit 12) are also dropped onto the withdrawal transport unit 17. The withdrawal transport unit 17 transports the rejected coins diverted by the coin diverter 14 and the coins fed from the storing/feeding units 16*aa* to 16*ad* to the outlet 3. The withdrawal transport unit 17 transports the dropped coins to the output 3, for example, with the aid of a transport belt.

The collection box 18 stores collected coins diverted by the coin diverter 14. The collection box 18 is a box having no drawing function but dedicated to storage. The collected coins stored in the collection box 18 can be extracted by accessing the interior of the coin handling apparatus 1. Instead, the collection box 18 may have a removable cassette structure. The collection box 18 is provided below the transport unit 12 but above the withdrawal transport unit 17. Providing the collection box 18 in a front portion of the coin handling apparatus 1, specifically, in front of the storing/feeding unit 16*aa* allows the collected coins to be readily extracted.

Figure 3:
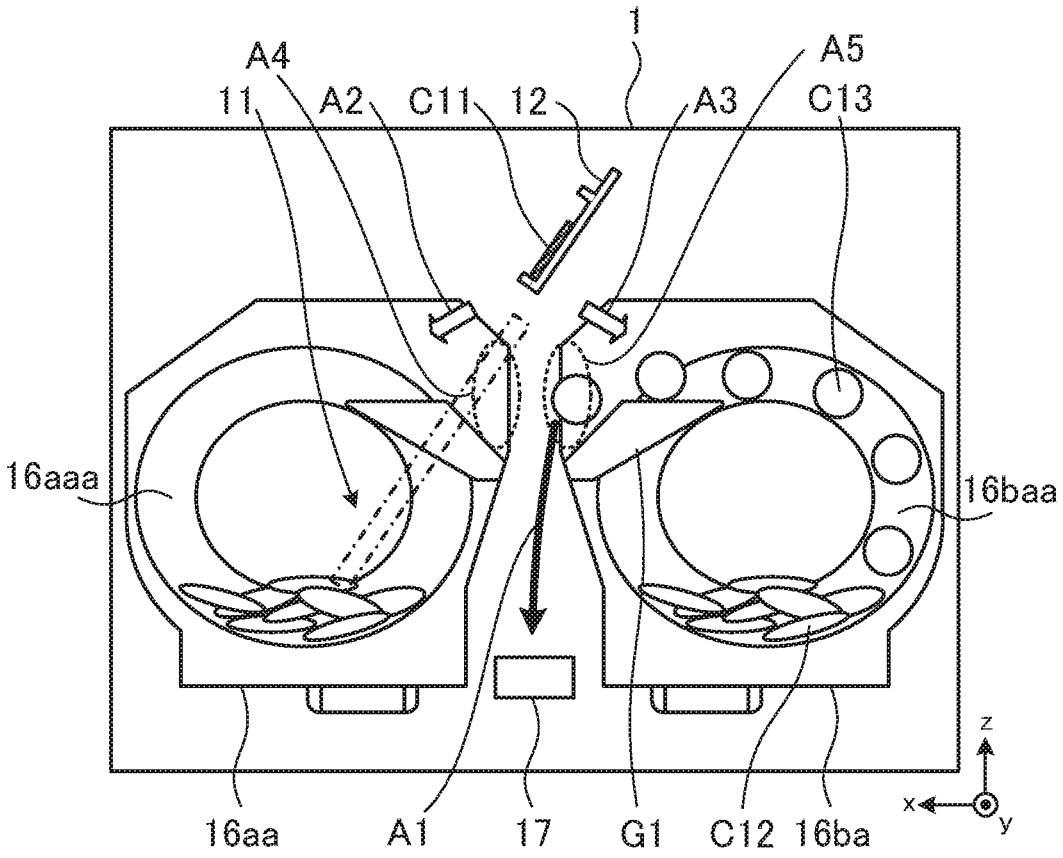
FIG. 3 is a cross-sectional view taken along the line A-A indicated by the arrows in FIG. 2.

FIG. 3 is a cross-sectional view taken along the line A-A in FIG. 2. In FIG. 3, the same portions as those in FIG. 2 have the same reference characters. In FIG. 3, part of the components shown in FIG. 2 is omitted.

The coin handling apparatus 1 includes a storing/feeding unit 16*ba*, as shown in FIG. 3. The storing/feeding unit 16*ba* is so provided as to face the storing/feeding unit 16*aa* via the transport unit 12.

The chain line shown in FIG. 3 represents the inclining disk 11*a* of the accumulation feeder 11. FIG. 3 also shows a coin C11 transported by the transport unit 12. The transport path of the transport unit 12, which transports the coin C11, inclines, as shown in FIG. 3.

The direction in which the coin C11 is transported by the transport unit 12 is diverted by the coin diverter 15*a* (not shown in FIG. 3) in accordance with the result of the identification performed by the identifying unit 13. The coin C11 transported by the transport unit 12 is stored in the storing/feeding unit 16*aa* or 16*ba*.

For example, in a case where the coin C11 is of the denomination to be stored in the storing/feeding unit 16*aa*, the transport direction is diverted (changed) as indicated by the arrow A2. The coin C11 diverted in the direction indicated by the arrow A2 is stored in the storing/feeding unit 16*aa*. In a case where the coin C11 is of the denomination to be stored in the storing/feeding unit 16*ba*, the transport direction is diverted as indicated by the arrow A3. The coin C11 diverted in the direction indicated by the arrow A3 is stored in the storing/feeding unit 16*ba*.

The storing/feeding unit 16*aa* includes an inclining disk 16*aaa*. The inclining disk 16*aaa*, along with a hopper, forms a space that stores coins. The inclining disk 16*aaa* rotates clockwise in FIG. 3 at the time of withdrawal to pick up coins stored in the hopper and feeds the coins to the feeding exit.

The storing/feeding unit 16*ba* includes an inclining disk 16*baa*. The inclining disk 16*baa*, along with a hopper, forms a space that stores coins. The inclining disk 16*baa* rotates counterclockwise in FIG. 3 at the time of withdrawal to pick up coins stored in the hopper and feeds the coins to the feeding exit.

A coin C12 shown in FIG. 3 represents a coin stored in the hopper of the storing/feeding unit 16*ba*. A coin C13 represents a coin to be fed from the storing/feeding unit 16*ba*. The coin C13 is caught by a protrusion (not shown) on the inclining disk 16*baa*, which is provided in the storing/feeding unit 16*ba*, and picked up. The coin C13 then mounts on the upper end of a plate-shaped guide G1, therefore separates from the inclining disk, and drops onto the withdrawal transport unit 17, as indicated by the arrow A1 in FIG. 3. The dotted-line frames A4 and A5 in FIG. 3 represent the positions of the feeding exits via which coins are fed.

Figure 4:
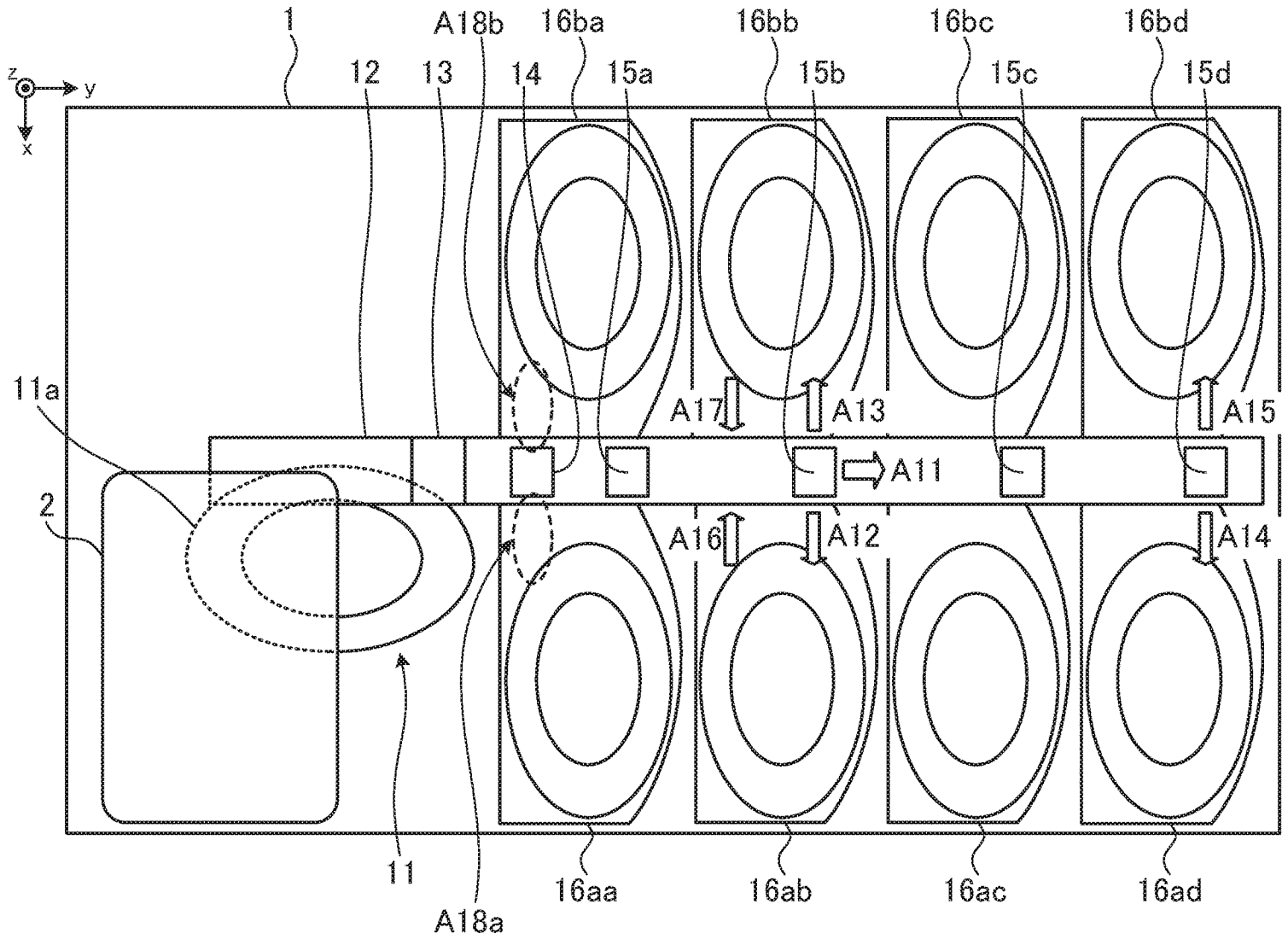
FIG. 4 shows the coin handling apparatus in FIG. 2 viewed in a +z-axis direction.

FIG. 4 shows the coin handling apparatus 1 in FIG. 2 viewed in the +z-axis direction. In FIG. 4, the same portions as those in FIGS. 2 and 3 have the same reference characters.

The coin handling apparatus 1 includes storing/feeding units 16*bb* to 16*bd*, as shown in FIG. 4. The storing/feeding units 16*bb* to 16*bd* are so provided as to face the storing/feeding units 16*ab* to 16*ad* via the transport unit 12. That is, the row of the storing/feeding units 16*aa* to 16*ad* and the row of the storing/feeding units 16*ba* to 16*bd* are disposed on the right and left sides of the transport unit 12 (or withdrawal transport unit 17) in the plan view.

In the following description, the storing/feeding units 16*aa* to 16*ad*, which are located on the right side when viewed from the side facing the front of the apparatus (in −y-axis direction), are referred to as right-row storing/feeding units 16*aa* to 16*ad* in some cases. Similarly, the storing/feeding units 16*ba* to 16*bd*, which are located on the left side when viewed from the side facing the front of the apparatus, are referred to as left-row storing/feeding units 16*ba* to 16*bd* in some cases.

The coin diverters 14 and 15*a* to 15*c* divert the coins transported by the transport unit 12 in the three directions, as described above. For example, the coin diverter 15*b* diverts the coins transported by the transport unit 12 in the downstream transport direction, as indicated by the arrow A11. The coin diverter 15*b* diverts the coins transported by the transport unit 12 in the direction toward the storing/feeding unit 16*ab*, as indicated by the arrow A12. The coin diverter 15*b* diverts the coins transported by the transport unit 12 in the direction toward the storing/feeding unit 16*bb*, as indicated by the arrow A13. The coin diverter 15*d* diverts the coins only in the two directions, as indicated by the arrows A14 and A15.

The storing/feeding units 16*aa* to 16*ad* and 16*ba* to 16*bd* feed coins stored therein at the time of withdrawal. For example, the storing/feeding units 16*ab* and 16*bb* feed coins stored therein in the positions indicated by the arrows A16 and A17 (see positions of feeding exits indicated by dotted-line frames A4 and A5 in FIG. 3). The fed coins are dropped onto the withdrawal transport unit 17, as indicated by the arrow A1 in FIG. 3, and withdrawn via the outlet 3.

The dotted-line frames A18*a* and A18*b* in FIG. 4 represent the positions of the feeding exits via which coins in the storing/feeding units 16*aa* and 16*ba* are fed. The feeding exits indicated by the dotted-line frames A18*a* and A18*b* correspond to the feeding exits indicated by the dotted-line frames A4 and A5 in FIG. 3. The storing/feeding units 16*ab* to 16*ad* and 16*bb* to 16*bd* also have feeding exits in positions similar to the positions of the feeding exits of the storing/feeding units 16*aa* and 16*ba*. The storing/feeding units 16*ab* to 16*ad* and 16*bb* to 16*bd* are so disposed that the feeding exits thereof face each other via the transport unit 12.

The inclining disk of each of the storing/feeding units 16*ab* to 16*ad* shown in FIG. 4 rotates in the same direction in which the inclining disk 16*aaa* of the storing/feeding unit 16*aa* described with reference to FIG. 3 rotates. The inclining disk of each of the storing/feeding units 16*bb* to 16*bd* shown in FIG. 4 rotates in the same direction in which the inclining disk of the storing/feeding unit 16*ba* described with reference to FIG. 3 rotates. That is, the inclining disks of the right-row storing/feeding units 16*aa* to 16*ad* and the inclining disks of the left-row storing/feeding units 16*ba* to 16*bd* rotate in opposite directions.

The coin handling apparatus 1 may include differently configured storing/feeding units mixed with one another. For example, the storing/feeding units 16*aa* to 16*ad* and the storing/feeding units 16*ba* to 16*bd* are configured differently from each other. For example, in the storing/feeding units 16*ba* to 16*bd*, the inclining disks rotate in the opposite direction. For example, the storing/feeding units 16*aa* to 16*ad* and the storing/feeding units 16*ba* to 16*bd* are bilaterally symmetric with respect to the transport unit 12 in terms of the shape of the guides, the shape of the hoppers, the shape of the protrusions on the inclining disks, and other factors (see FIG. 3, for example). At least one of the storing/feeding units 16*aa* to 16*ad* and 16*ba* to 16*bd* may differ from the others in terms of configuration.

Specific actions of the coin handling apparatus 1 will be described with reference to FIG. 2. A deposit action will first be described.

Coins put into the inlet 2 are accumulated in the hopper of the accumulation feeder 11. The coins accumulated in the hopper of the accumulation feeder 11 are picked up by the inclining disk 11*a* and fed onto the transport unit 12.

The coins fed onto the transport unit 12 are identified by the identifying unit 13. In a case where the identified coins are not rejected coins or collected coins, the direction in which the coins are transported is diverted by the coin diverters 15*a* to 15*d*, and the coins are stored in one of the storing/feeding units 16*aa* to 16*ad* and 16*ba* to 16*bd*.

In a case where the identified coins are rejected coins, the direction in which the rejected coins are transported is diverted by the coin diverter 14, and the rejected coins are dropped onto the withdrawal transport unit 17. The rejected coins dropped onto the withdrawal transport unit 17 are transported to the outlet 3.

In a case where the identified coins are collected coins, the direction in which the collected coins are transported is diverted by the coin diverter 14, and the collected coins are dropped into the collection box 18 and stored therein.

A withdrawal action will next be described.

The coins stored in the storing/feeding units 16*aa* to 16*ad* and 16*ba* to 16*bd* are picked up by the inclining disks provided in the storing/feeding units 16*aa* to 16*ad* and 16*ba* to 16*bd*. The picked-up coins are led along the guides to the feeding exits (see FIG. 3) and dropped onto the withdrawal transport unit 17. The coins dropped onto the withdrawal transport unit 17 are transported to the outlet 3.

An example of the disposition of conventional storing/feeding units (PTL 1) will now be schematically described.

Figure 5:
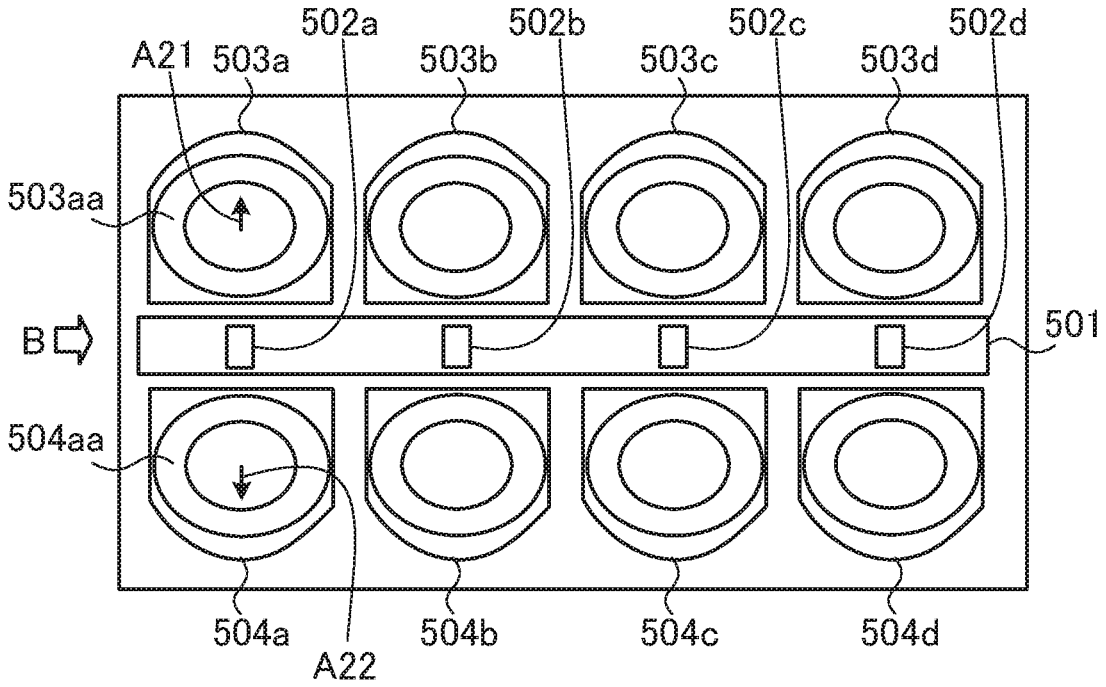
FIG. 5 schematically describes an example of the disposition of conventional storing/feeding units.

FIG. 5 schematically describes an example of the disposition of the conventional storing/feeding units. FIG. 5 is a schematic plan view of the coin handling apparatus described in PTL 1. The coin handling apparatus includes a transport unit 501, coin diverters 502*a* to 502*d*, and storing/feeding units 503*a* to 503*d* and 504*a* to 504*d*, as shown in FIG. 5.

The transport unit 501 transports coins from the left side toward the right side in FIG. 5. The coin diverters 502*a* to 502*d* divert the direction in which the coins are transported by the transport unit 501 in such a way that the coins are stored in the storing/feeding units 503*a* to 503*d* and 504*a* to 504*d*. Specifically, the coin diverters 502*a* to 502*d* each have two coin selection holes. For example, the coin diverter 502*a* has a selection hole corresponding to the storing/feeding unit 503*a* and a selection hole corresponding to the storing/feeding unit 504*a*.

The storing/feeding units 503*a* and 504*a* have inclining disks 503*aa* and 504*aa*, which feed stored coins. The storing/feeding units 503*b* to 503*d* and 504*b* to 504*d* also have inclining disks, as do the storing/feeding units 503*a* and 504*a*.

The storing/feeding units 503*a* to 503*d* and 504*a* to 504*d* are so disposed that the axes of rotation of the inclining disks are parallel to a plane perpendicular to the direction in which the transport unit 501 transports coins (rightward/leftward direction in FIG. 5). For example, the axis of rotation of the inclining disk 503*aa* of the storing/feeding unit 503*a* is parallel to a plane perpendicular to the direction in which the transport unit 501 transports coins (rightward/leftward direction in FIG. 5), as indicated by the arrow A21. Similarly, the axis of rotation of the inclining disk 504*aa* of the storing/feeding unit 504*a* is parallel to a plane perpendicular to the direction in which the transport unit 501 transports coins, as indicated by the arrow A22.

The storing/feeding units 16*aa* to 16*ad* and 16*ba* to 16*bd* of the coin handling apparatus 1 shown in FIG. 4 are so disposed that the axes of rotation of the inclining disks intersect a plane (x-z plane) perpendicular to the direction in which the transport unit 12 transports coins (y-axis direction). The storing/feeding units 16*aa* to 16*ad* and 16*ba* to 16*bd* may further be so disposed that the axes of rotation of the inclining disks are parallel to a vertical plane (y-z plane) containing the direction in which the transport unit 12 transports coins (y-axis direction).

Figure 6:
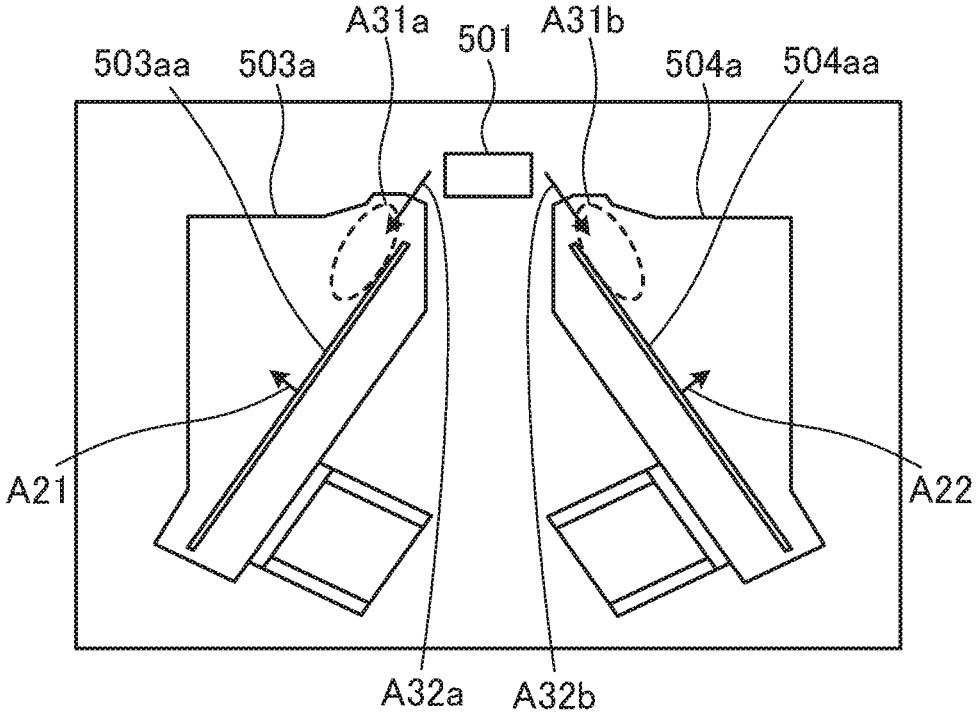
FIG. 6 shows a coin handling apparatus shown in FIG. 5 and viewed in the direction of the arrow B.

FIG. 6 shows the coin handling apparatus shown in FIG. 5 and viewed in the direction of the arrow B. In FIG. 6, the same portions as those in FIG. 5 have the same reference characters.

The inclining disks 503*aa* and 504*aa* of the storing/feeding units 503*a* and 504*a*, specifically, the protrusions on the front surfaces thereof catch coins held in the hoppers and pick the coins up. The inclining disks 503*aa* and 504*aa* of the storing/feeding units 503*a* and 504*a* then feed the picked-up coins via coin feeding exits.

The dotted-line frames A31*a* and A31*b* in FIG. 6 represent the positions of the coin feeding exits of the storing/feeding units 503*a* and 504*a*. The coin feeding exits of the storing/feeding units 503*a* and 504*a* are provided in the vicinity of upper portions of the inclining disks 503*aa* and 504*aa*.

The arrows A32*a* and A32*b* in FIG. 6 represent the directions in which the coin diverters (not shown in FIG. 6) drop the coins from the transport unit 501.

The highest portion of each of the inclining disks 503*aa* and 504*aa* is closer to the transport unit 501 than the lowest portion thereof. The coins dropped from the transport unit 501 enter the storing/feeding units 503*a* and 504*a* via portions close to the upper portions of the inclining disks 503*aa* and 504*aa*, as indicated by the arrows A31*a* and A31*b* and the arrows A32*a* and A32*b*. The coins dropped from the transport unit 501 conform to the coin feeding exits of the storing/feeding units 503*a* and 504*a*. Therefore, for example, when the coins stack in the vicinity of the coin feeding exits, the storing/feeding units 503*a* and 504*a* cannot appropriately feed the coins.

In contrast, the coin handling apparatus 1 shown in FIGS. 1 to 4 can appropriately feed coins. The reason for this will be described below.

The storing/feeding units 16*aa* to 16*ad* and 16*ba* to 16*bd* form a plurality of rows along the transport unit 12, as shown in FIGS. 2 to 4. For example, the storing/feeding units 16*aa* to 16*ad* form a row along the transport unit 12, and the storing/feeding units 16*ba* to 16*bd* form another row along the transport unit 12.

The storing/feeding units 16*aa* to 16*ad* and 16*ba* to 16*bd*, which form the rows, are so disposed that the front surface of each of the inclining disks face the rear surface of the inclining disk adjacent thereto. For example, in the storing/feeding unit 16*aa* in FIG. 2, a surface S1 represents the front surface of the inclining disk, and a surface S2 represents the rear surface of the inclining disk. In the storing/feeding unit 16*ab* in FIG. 2, a surface S3 represents the front surface of the inclining disk, and a surface S4 represents the rear surface of the inclining disk. The surface S1 (front surface) of the inclining disk of the storing/feeding unit 16*aa* faces the surface S4 (rear surface) of the inclining disk of the storing/feeding unit 16*ab*. In other words, the inclining disks of the storing/feeding units 16*aa* to 16*ad*, which form one row, are not in the same plane but are disposed in parallel to one another. The same holds true for the storing/feeding units 16*ba* to 16*bd*, which form the other row. In still other words, in each of the storing/feeding units 16*aa* to 16*ad* and 16*ba* to 16*bd*, the highest portion of the inclining disk and the lowest portion of the inclining disk are separate from the y-z plane containing the transport unit 12 by the same distance. Adjusting the positions of the coin diverters 15*a* to 15*d*, which are disposed along the transport unit 12, therefore allows coins to drop from the coin diverters 15*a* to 15*d* onto arbitrary positions on the including disks.

Disposing the storing/feeding units 16*aa* to 16*ad* and 16*ba* to 16*bd* as described above allows coins to drop from each of the coin diverters 15*a* to 15*d* onto a portion separate from the highest position of the inclining disk. The disposition described above can avoid the situation in which the coins dropped from the coin diverters 15*a* to 15*d* stack in the vicinity of the feeding exits of the storing/feeding units 16*aa* to 16*ad* and 16*ba* to 16*bd*.

For example, the positions where coins that drop from the transport unit 12 into the storing/feeding units 16*aa* to 16*ad* and 16*ba* to 16*bd* (see coins drop positions indicated by arrows A12 and A13 in FIG. 4, for example) can be shifted from the coin feeding exits of the storing/feeding units 16*aa* to 16*ad* and 16*ba* to 16*bd* (see feeding exits indicated by arrows A16 and A17 in FIG. 4, for example). More specifically, the coin diverters 15*a* to 15*d* can each be so disposed that coins drop in a position separate from the highest position of the inclining disk. The disposition described above can avoid the situation in which coins stack in the vicinity of the feeding exits of the storing/feeding units 16*aa* to 16*ad* and 16*ba* to 16*bd*.

The coin diverter 15*a* will be described. The coin diverters 14 and 15*b* to 15*d* have the same configuration as that of the coin diverter 15*a* and will not described below.

Figure 7:
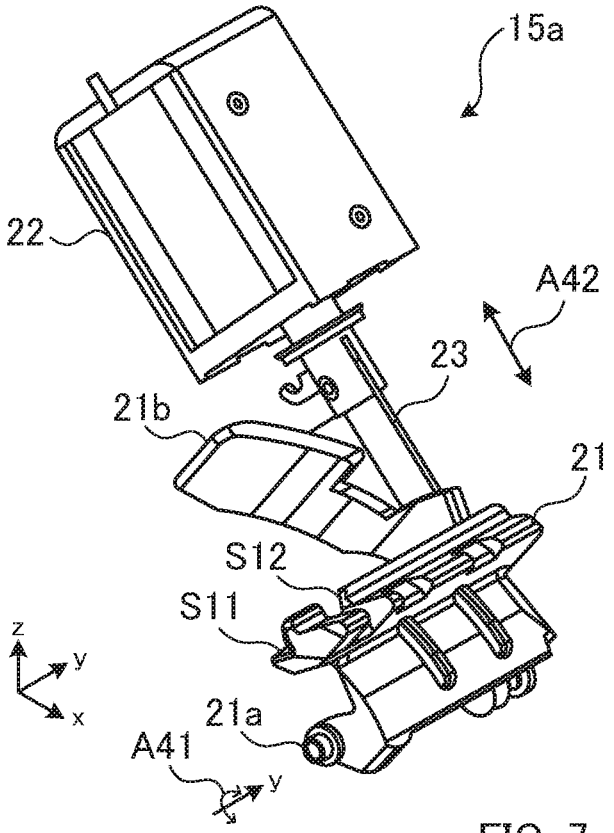
FIG. 7 is a perspective view of parts that form a coin diverter.
Figure 8:
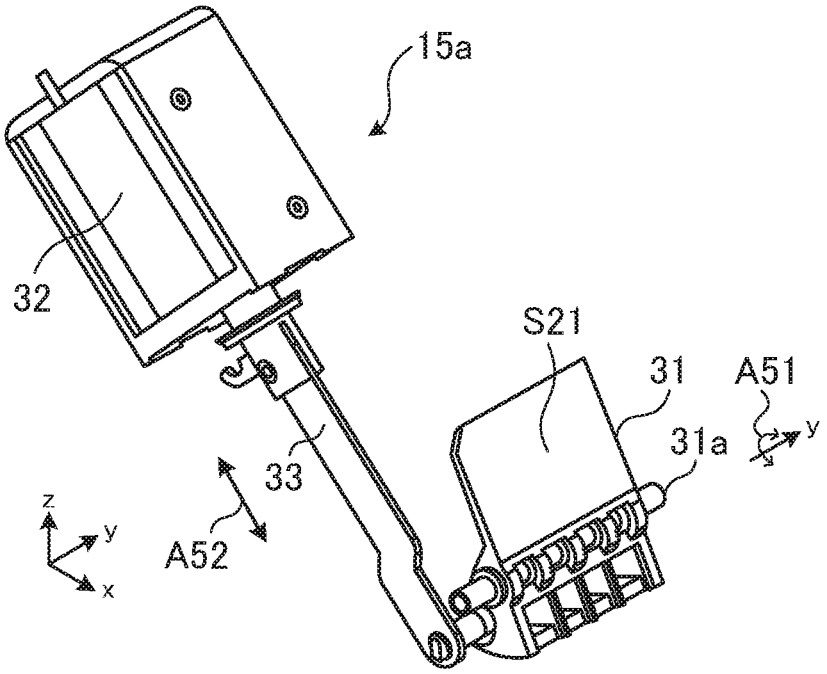
FIG. 8 is a perspective view of parts the form the coin diverter.

FIG. 7 is a perspective view of parts that form the coin diverter 15*a*. The coin diverter 15*a* is formed of the parts shown in FIG. 7 and the parts shown in FIG. 8, which will be described later (see FIG. 9, for example). The coin diverter 15*a* shown in FIGS. 7 and 8 is disposed in an opening formed in the transport path of the transport unit 12 (see FIG. 9, for example).

The coin diverter 15*a* includes an A gate 21, an actuator 22, and a linkage member 23, as shown in FIG. 7.

The A gate 21 has a bottom surface S11 and a side surface S12. The bottom surface S11 and the side surface S12 form an L-letter-shaped surface. The lower end of the circumferential edge of a coin comes into contact with (mounts on) the bottom surface S11. The bottom surface S11 and the side surface S12 form part of the transport path of the transport unit 12, as will be described below.

The A gate 21 pivots around a shaft 21*a*, which extends in the y-axis direction and serves as the axis of pivotal motion. The A gate 21 pivots around the shaft 21*a* clockwise and counterclockwise, as indicated by the double-headed arrow A41 shown in FIG. 7.

The A gate 21 includes a guide 21*b*. The guide 21*b* has an arcuate shape.

One end of the linkage member 23 is connected to the actuator 22. The actuator 22 linearly moves the linkage member 23 in the direction indicated by the double-headed arrow A42 in FIG. 7. The other end of the linkage member 23 is connected to the A gate 21 and linearly moves to cause the A gate 21 to pivot in the direction indicated by the double-headed arrow A41.

FIG. 8 is a perspective view of parts that form the coin diverter 15*a*. The coin diverter 15*a* includes a B gate 31, an actuator 32, and a linkage member 33, as shown in FIG. 8.

The B gate 31 has a side surface S21. One of the flat surfaces of a coin comes into contact with (mounts on) the side surface S21. The side surface S21 forms part of the transport path of the transport unit 12, as will be described below.

The B gate 31 pivots around a shaft 31*a*, which extends in the y-axis direction and serves as the axis of pivotal motion. The B gate 31 pivots around the shaft 31*a* clockwise and counterclockwise, as indicated by the double-headed arrow A51 shown in FIG. 8.

One end of the linkage member 33 is connected to the actuator 32. The actuator 32 linearly moves the linkage member 33 in the direction indicated by the double-headed arrow A52 in FIG. 8. The other end of the linkage member 33 is connected to the B gate 31 and linearly moves to cause the B gate 31 to pivot in the direction indicated by the double-headed arrow A51.

Figure 9:
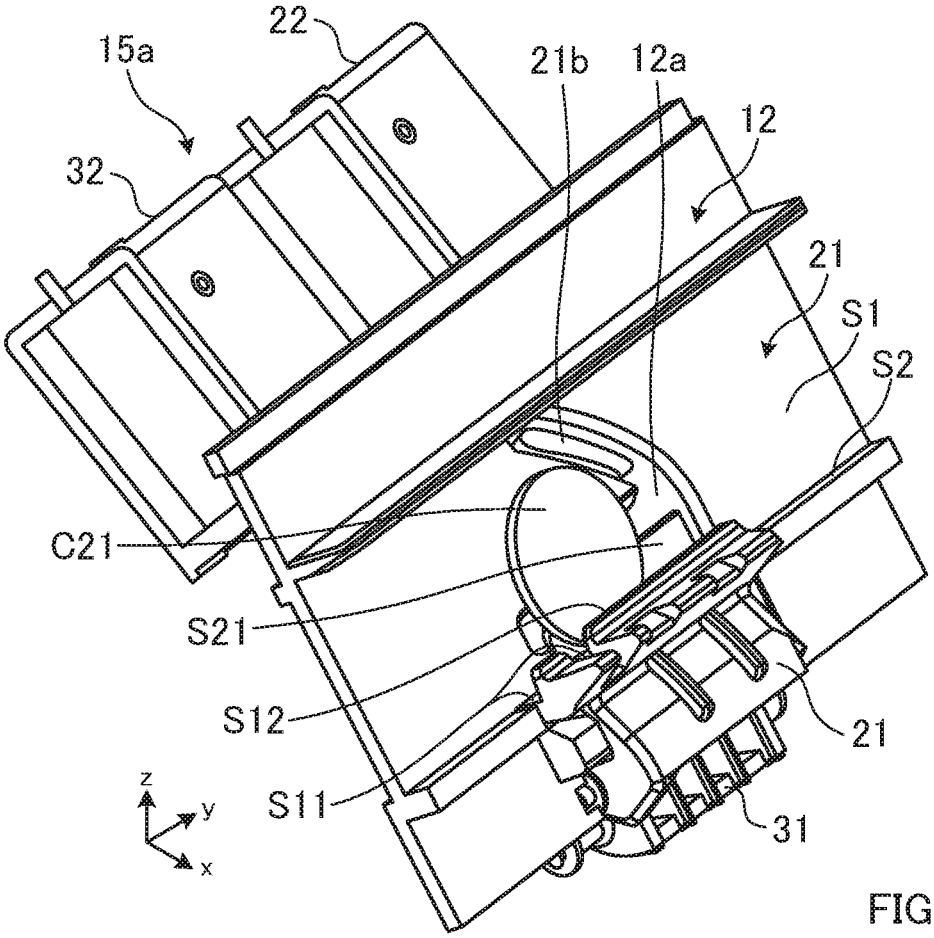
FIG. 9 is a perspective view of the coin diverter attached to a transport unit.
Figure 10:
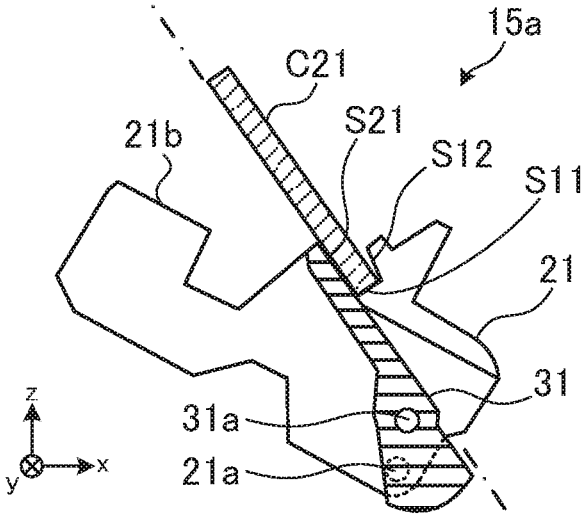
FIG. 10 shows the coin diverter viewed along a −y-axis direction.

FIG. 9 is a perspective view of the coin diverter 15*a* attached to the transport unit 12. FIG. 10 shows the coin diverter 15*a* shown in FIGS. 7 and 8 and part of the transport unit 12 shown in FIG. 3 and other figures. In FIG. 9, the same portions as those in FIGS. 7 and 8 have the same reference characters.

FIG. 9 shows a coin C21. The coin C21 is transported in the +y-axis direction, for example, by using a typical technology using a transport belt, as described above.

The A gate 21 and the B gate 31 are provided in an opening 12*a* provided in the transport unit 12, as shown in FIG. 9. The A gate 21 is so provided that the arcuate guide 21*b* is located along an arcuate portion of the opening 12*a*.

In FIG. 9, the bottom surface S11 of the A gate 21 is flush with a bottom surface S2 of the transport path of the transport unit 12. The side surface S12 of the A gate 21 faces a side surface S1 of the transport path of the transport unit 12. The side surface S21 of the B gate 31 is flush with the side surface S1 of the transport path of the transport unit 12. That is, the bottom surface S11 and the side surface S12 of the A gate 21 and the side surface S21 of the B gate 31 form a U-letter-shaped transport path in the opening 12*a* in the state shown in FIG. 9.

The coin C21 is therefore so transported as to pass the opening 12*a* and travel toward the downstream side of the transport unit 12 (in +y-axis direction). The coin C21 is therefore not led in the direction indicated, for example, by the arrow A2 or A3 shown in FIG. 3 or stored in the storing/feeding unit 16*aa* or 16*ba*.

FIG. 10 shows the coin diverter 15*a* viewed along the −y-axis direction. In FIG. 10, the same portions as those in FIGS. 7 to 9 have the same reference characters. In FIG. 10, the actuators 22 and 32 and the linkage members 23 and 33 are omitted. The coin diverter 15*a* shown in FIG. 10 is simplified in terms of shape and other factors, as compared with the coin diverter 15*a* shown in FIGS. 7 to 9. The chain line shown in FIG. 10 represents the position of the side surface S1 of the transport unit 12 shown in FIG. 9.

In the state shown in FIG. 10, in which the A gate 21 and the B gate 31 have pivoted under the control of the actuators 22 and 32, the bottom surface S11 of the A gate 21, the side surface S21 of the A gate 21, and the side surface S21 of the B gate 31 form the U-letter-shaped transport path in the opening 12*a* provided in the transport unit 12. That is, the coin diverter 15*a* forms a transport path along which the coin C21 travels along the +y-axis direction. The coin C21 is therefore transported toward the downstream side of the transport unit 12.

Figure 11:
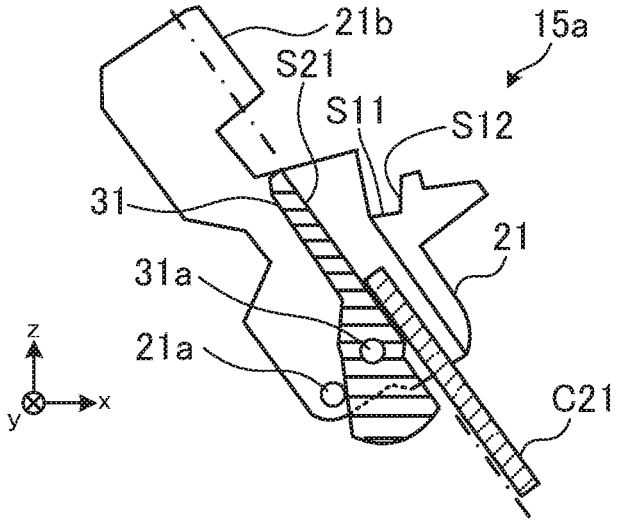
FIG. 11 shows the coin diverter viewed along the −y-axis direction.

FIG. 11 shows the coin diverter 15*a* viewed along the −y-axis direction. In FIG. 11, the same portions as those in FIG. 10 have the same reference characters.

The A gate 21 shown in FIG. 11 has pivoted clockwise around the shaft 21*a*, which serves as the axis of pivotal motion, with respect to the A gate 21 shown in FIG. 10. On the other hand, the B gate 31 has not pivoted from the state shown in FIG. 10.

As a result, the bottom surface S11 of the A gate 21 is separate from the bottom surface S2 of the transport unit 12, and a bottom surface portion of the opening 12*a* of the transport unit 12 is therefore unblocked. The coin C21 slides along the side surface S21 of the B gate 31 and drops through the bottom portion of the opening 12*a*, as shown in FIG. 11. The coin C21 having slid along the side surface S21 of the B gate 31 and dropped through the bottom portion of the opening 12*a* travels along a chute connected to the storing/feeding unit 16*aa* and is stored in the storing/feeding unit 16*aa*.

The guide 21*b* of the A gate 21 protrudes beyond the side surface S1 of the transport unit 12 (chain line shown in FIG. 12) in response to the clockwise pivotal motion of the A gate 21. The coin C21 is thus not allowed to travel in the downstream transport direction, reliably slides along the side surface S21 of the B gate 31, and drops through the bottom portion of the opening 12*a*.

Figure 12:
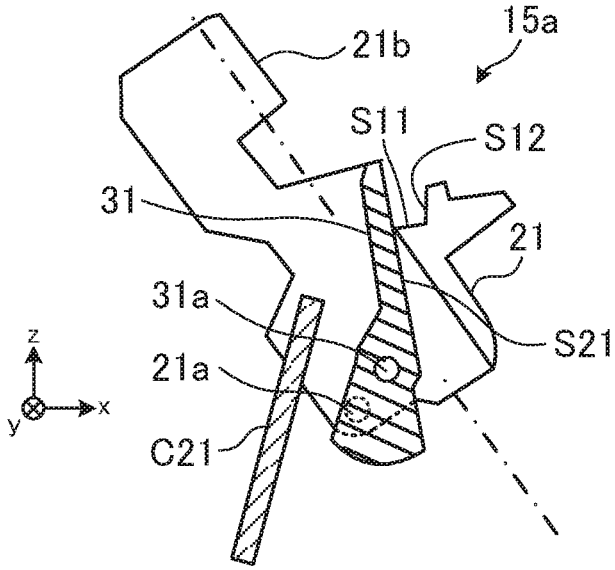
FIG. 12 shows the coin diverter viewed along the −y-axis direction.

FIG. 12 shows the coin diverter 15*a* viewed along the −y-axis direction. In FIG. 12, the same portions as those in FIG. 10 have the same reference characters.

The B gate 31 shown in FIG. 12 has pivoted clockwise around the shaft 31*a*, which serves as the axis of pivotal motion, with respect to the B gate 31 shown in FIG. 11. On the other hand, the A gate 21 has not pivoted from the state shown in FIG. 11.

As a result, the side surface S21 of the B gate 31 is shifted from the side surface S1 of the transport unit 12, and a side portion of the opening 12*a* of the transport unit 12 is therefore unblocked. The coin C21 passes through the side portion of the opening 12*a* and drops along the rear side of the B gate 31, as shown in FIG. 12. The coin C21 having dropped along the rear side of the B gate 31 travels along a chute connected to the storing/feeding unit 16*ba* and is stored in the storing/feeding unit 16*ba*.

The guide 21*b* of the A gate 21 protrudes beyond the side surface S1 of the transport unit 12 (chain line shown in FIG. 12) in the state shown in FIG. 12. The coin C21 is thus not allowed to travel in the downstream transport direction, as described above, passes through the side portion of the opening 12*a*, and reliably drops along the rear side of the B gate 31.

The coin diverter 15*a* is configured as a single module including the A gate 21, the B gate 31, the linkage members 23 and 33, and the actuators 22 and 32, as described with reference to FIGS. 7 to 12. The coin diverter 15*a*, which is configured as the single module, diverts the coins transported by the transport unit 12 to the right and left storing/feeding units 16*aa* to 16*ad* and 16*ba* to 16*bd*.

The coin diverter 15*a* is not necessarily configured as a single module. For example, two two-way diverters which each divert a coin in two directions, may be provided between the storing/feeding unit 16*aa* and the storing/feeding unit 16*ba*. More specifically, a two-way diverter that diverts and leads a coin to one of the storing/feeding unit 16*aa* and the downstream transport direction and a two-way diverter that diverts and leads the coin to one of the storing/feeding unit 16*ba* and the downstream transport direction may be disposed between the storing/feeding unit 16*aa* and the storing/feeding unit 16*ba* and along a roughly straight line.

The two-way diverters may each be formed of a typical apparatus. For example, the diverters (selectors) disclosed in Japanese Patent Application Laid-Open No. 2012-174035 and Japanese Patent Application Laid-Open No. 2015-49700 can be used.

Coin feeding control will be described. The feeding exits of the storing/feeding units 16*aa* to 16*ad* and the feeding exits of the storing/feeding units 16*ba* to 16*bd* face each other via the transport unit 12 and the withdrawal transport unit 17. For example, the dotted-frames A18*a* and A18*b* in FIG. 4 represent the position of the feeding exit of the storing/feeding unit 16*aa* and the position of the feeding exit of the storing/feeding unit 16*ba*, respectively, and the feeding exits face each other via the transport unit 12 and the withdrawal transport unit 17. Therefore, when the right storing/feeding units 16*aa* to 16*ad* and the left storing/feeding units 16*ba* to 16*bd* simultaneously feed coins, the coins are likely to collide with each other at the feeding exits.

To avoid the collision, a controller (not shown) controls the storing/feeding units 16*aa* to 16*ad* and 16*ba* to 16*bd*, which are adjacent to each other on the right and left sides of the transport unit 12 and the withdrawal transport unit 17, not to simultaneously feed coins. For example, the controller controls the storing/feeding units 16*aa* and 16*ba* in such a way that the storing/feeding unit 16*aa* is allowed to feed coins but the storing/feeding unit 16*ba*, which faces the storing/feeding unit 16*aa* via the withdrawal transport unit 17, is allowed to feed no coins and vice versa. Instead, for example, the controller controls the storing/feeding units 16*aa* and 16*ba* to alternately feed coins onto the withdrawal transport unit 17. The controller can thus avoid the collision between coins fed from the right and left storing/feeding units 16*aa* to 16*ad* and 16*ba* to 16*bd*.

On the other hand, the controller can control the storing/feeding units (storing/feeding units 16*aa* to 16*ad* or the storing/feeding units 16*ba* to 16*bd*) arranged in rows in the transport direction of the transport unit 12 in such a way that a plurality of the storing/feeding units in one of the rows simultaneously feed coins onto the withdrawal transport unit 17. For example, the controller may control the storing/feeding units in such a way that at least a set of storing/feeding units adjacent to each other in one of the rows simultaneously feed coins onto the withdrawal transport unit 17. The controller may instead control the storing/feeding units in such a way that an arbitrary number of the storing/feeding units in one of the rows simultaneously feed coins onto the withdrawal transport unit 17.

When coins are dropped on the withdrawal transport unit 17, the coins may bounce back and possibly cause the apparatus to malfunction or otherwise fail. For example, in the case where the withdrawal transport unit 17 is formed of a transport belt, coins having dropped on the transport belt bounce back in some cases. The amount of the bounce is greater when the withdrawal transport unit 17 is in operation than when the withdrawal transport unit 17 is stationary. In view of the fact described above, the controller causes the withdrawal transport unit 17 to stop operating when coins are fed from any of the storing/feeding units 16*aa* to 16*ad* and 16*ba* to 16*bd*. The controller can thus prevent coins from bouncing back off the withdrawal transport unit 17 and hence prevent the apparatus from malfunctioning or otherwise failing.

Further, when coins are fed from the storing/feeding units 16*aa* to 16*ad* and 16*ba* to 16*bd*, and the withdrawal transport unit 17 is caused to stop operating, a large number of coins stack at one location on the withdrawal transport unit 17, and the action of the withdrawal transport unit 17 is possibly hindered. When coins are alternately fed from the right and left storing/feeding units 16*aa* to 16*ad* and 16*ba* to 16*bd*, the controller may allow the withdrawal transport unit 17 to operate stepwise by a small distance. For example, the controller causes the withdrawal transport unit 17 to stop operating and allows one of the rows of the storing/feeding units 16*aa* to 16*ad* and 16*ba* to 16*bd* to feed a predetermined number of coins. After the predetermined number of coins are fed from one of the rows of the storing/feeding units 16*aa* to 16*ad* and 16*ba* to 16*bd*, the controller causes the withdrawal transport unit 17 to move by a small distance, causes the withdrawal transport unit 17 to stop operating again, and allows the other one of the rows of the storing/feeding units 16*aa* to 16*ad* and 16*ba* to 16*bd* to feed a predetermined number of coins. The operation described above avoids the situation in which coins fed from the right and left storing/feeding units 16*aa* to 16*ad* and 16*ba* to 16*bd* stack at one location on the withdrawal transport unit 17. For example, in the case where the withdrawal transport unit 17 is formed of a transport belt, the situation in which coins stack at one location on the transport belt is avoided. That is, the situation in which a large number of fed coins stack on the withdrawal transport unit 17 can be avoided. The number (predetermined number) of fed coins is determined, for example, based on the volume of each coin. The controller is formed, for example, of a CPU (central processing unit), a memory, and other components.

As described above, the coin handling apparatus 1 includes the storing/feeding units 16*aa* to 16*ad* and 16*ba* to 16*bd*, which each include the inclining disk, which is rotated in an inclining attitude in which the inclining disk inclines by a predetermined angle with respect to the vertical direction, and the transport unit 12 (or withdrawal transport unit 17), which transports coins. The storing/feeding units 16*aa* to 16*ad* and 16*ba* to 16*bd* form a plurality of rows along the transport unit 12, and the rows are each so disposed that faces of adjacent inclining disks in the row face each other.

The configuration described above prevents coins that drop into the storing/feeding units 16*aa* to 16*ad* and 16*ba* to 16*bd* so disposed as to sandwich the transport unit 12 from stacking in the vicinity of the feeding exits, whereby the coin handling apparatus 1 can appropriately feed coins.

In the above description, the number of storing/feeding units is eight, but not necessarily. Further, the storing/feeding units may differ in number between the right row and the left row.

In the above description, the number of rows of the storing/feeding units is two, but not necessarily. The number of rows of the storing/feeding units may be three or greater. For example, two transport units may be provided, and the rows of storing/feeding units may be formed along each of the two transport units (in this case, the number of rows of the storing/feeding units is four).

Embodiment 2

Embodiment 2 differs from Embodiment 1 in terms of the disposition of the storing/feeding units. For example, in Embodiment 2, the storing/feeding units in the right row and the storing/feeding units in the left row differ from each other in terms of the orientation of the front surface of each of the inclining disks.

Figure 13:
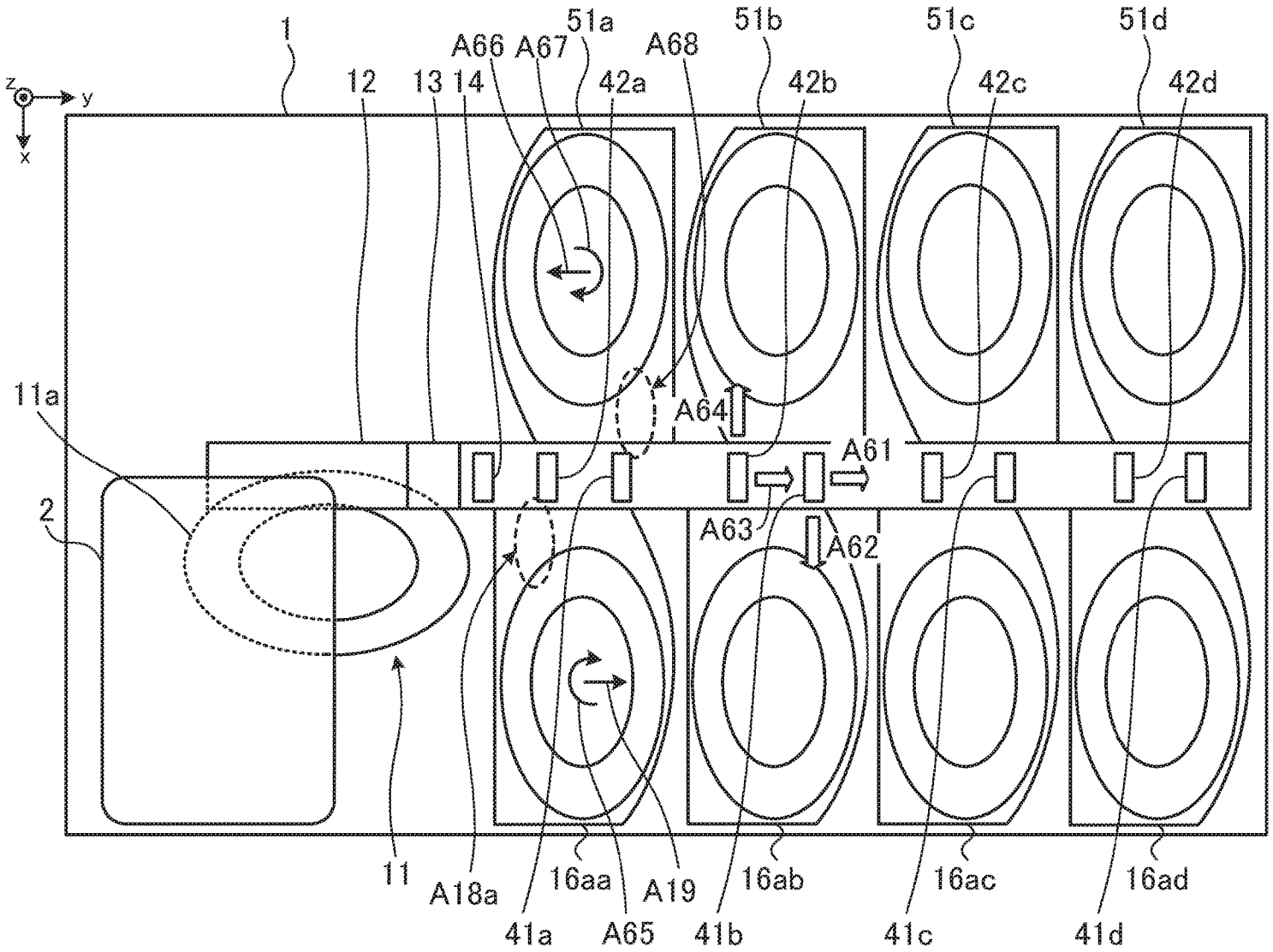
FIG. 13 is a plan view of a coin handling apparatus according to Embodiment 2.

FIG. 13 is a plan view of a coin handling apparatus 1 according to Embodiment 2. In FIG. 13, the same portions as those in FIG. 4 have the same reference characters.

The coin handling apparatus 1 includes coin diverters 41*a* to 41*d* and 42*a* to 42*d* and storing/feeding units 51*a* to 51*d*, as shown in FIG. 13.

The coin diverters 41*a* to 41*d* divert the coins transported by the transport unit 12 in two directions. For example, the coin diverters 41*a* to 41*d* divert the coins transported by the transport unit 12 in the downstream transport direction and the direction leading to the storing/feeding units 16*aa* to 16*ad*.

More specifically, the coin diverter 41*b* diverts the coins transported by the transport unit 12 in the downstream transport direction, as indicated by the arrow A61. The coin diverter 41*b* diverts the coins transported by the transport unit 12 in the direction leading to the storing/feeding unit 16*ab*, as indicated by the arrow A62. The coin diverter 41*d* diverts the coins transported by the transport unit 12 only in the direction leading to the storing/feeding unit 16*ad*.

The coin diverters 42*a* to 42*d* divert the coins transported by the transport unit 12 in two directions. For example, the coin diverters 42*a* to 42*d* divert the coins transported by the transport unit 12 in the downstream transport direction and the direction leading to the storing/feeding units 51*a* to 51*d*.

More specifically, the coin diverter 42*b* diverts the coins transported by the transport unit 12 in the downstream transport direction, as indicated by the arrow A63. The coin diverter 42*b* diverts the coins transported by the transport unit 12 in the direction leading to the storing/feeding unit 51*b* as indicated by the arrow A64.

The direction in which each of the storing/feeding units 51*a* to 51*d* is disposed differs from the direction in which each of the storing/feeding units 16*aa* to 16*ad* is disposed by 180 degrees. For example, the storing/feeding units 16*aa* to 16*ad* are each so configured that the front surface of the inclining disk faces the rear side of the apparatus (is oriented in +y-axis direction) (for example, surface S1 shown in FIG. 2 faces rear side of apparatus), whereas the storing/feeding units 51*a* to 51*d* are each so configured that the front surface of the inclining disk faces the front side of the apparatus.

The storing/feeding units 51*a* to 51*d* can, for example, be configured in the same manner in which the storing/feeding units 16*aa* to 16*ad* are configured. That is, the coin handling apparatus 1 can be formed of storing/feeding units of one type. For example, storing/feeding units of one type are so incorporated in the coin handling apparatus 1 that the storing/feeding units in the right row and the storing/feeding units in the left row angularly differ from each other by 180 degrees.

The inclining disk of the storing/feeding unit 16*aa* rotates around the axis indicated by the arrow A19 in FIG. 13. The storing/feeding unit 16*aa*, when it feeds coins stored in the hopper to the feeding exit (see dotted-line frame A4 in FIG. 3, for example), rotates the inclining disk in the direction indicated by the arrow A65 in FIG. 13 (rotates inclining disk clockwise when viewed along +y-axis direction) to feed the stored coins. The dotted-line frame A18*a* in FIG. 13 represents the position of the coin feeding exit. The coins drawn to the feeding exit drop onto the withdrawal transport unit 17 (not shown in FIG. 13).

The inclining disk of the storing/feeding unit 51*a* rotates around the axis indicated by the arrow A66 in FIG. 13. The storing/feeding unit 51*a*, when it feeds coins stored in the hopper to the feeding exit, rotates the inclining disk in the direction indicated by the arrow A67 in FIG. 13 (rotates inclining disk clockwise when viewed in −y-axis direction) to feed the stored coins. The dotted-line frame A68 in FIG. 13 represents the position of the coin feeding exit. The coins fed to the feeding exit drop onto the withdrawal transport unit 17 (not shown in FIG. 13).

As described above, the direction in which each of the storing/feeding units 16*aa* to 16*ad* is disposed differs from the direction in which each of the storing/feeding units 51*a* to 51*d* is disposed by 180 degrees in the apparatus. The storing/feeding units 16*aa* to 16*ad* and the storing/feeding units 51*a* to 51*d* form a plurality of rows along the transport unit 12.

As a result, the coin handling apparatus 1 shown in FIG. 13 can avoid the situation in which the coins dropped from the coin diverters 41*a* to 41*d* and 42*a* to 42*d* stack at the feeding exits of the storing/feeding units 16*aa* to 16*ad* and 51*a* to 51*d*, as in Embodiment 1.

For example, the position where coins drop from the transport unit 12 into the storing/feeding units 16*aa* to 16*ad* and 51*a* to 51*d* (see coin dropping positions indicated by arrows A62 and A64 in FIG. 13, for example) can be shifted from the coin feeding exits of the storing/feeding units 16*aa* to 16*ad* and 51*a* to 51*d* (see feeding exits indicated by dotted-line frames A18*a* and A68 in FIG. 13, for example). This can avoid the situation in which the coins stack at the feeding exits of the storing/feeding units 16*aa* to 16*ad* and 51*a* to 51*d*.

Further, the storing/feeding units 16*aa* to 16*ad* in the right row and the storing/feeding units 51*a* to 51*d* in the left row are so disposed with the withdrawal transport unit 17 therebetween that the feeding exits of the storing/feeding units 16*aa* to 16*ad* do not face the feeding exits of the storing/feeding units 51*a* to 51*d*. For example, the feeding exit indicated by the dotted-line frame A18*a* in FIG. 13 does not face the feeding exit indicated by A68 via the withdrawal transport unit 17.

As a result, the coins fed from the storing/feeding units 16*aa* to 16*ad* in the right row and the coins fed from the storing/feeding units 51*a* to 51*d* in the left row do not collide with each other. The controller (not shown) can therefore simultaneously allow the storing/feeding units 16*aa* to 16*ad* in the right row and the storing/feeding units 51*a* to 51*d* in the left row to feed the coins stored therein onto the withdrawal transport unit 17.

As described above, the storing/feeding units 16*aa* to 16*ad* and 51*a* to 51*d*, which are configured in the same manner, form a plurality of rows along the transport unit 12, and the rows are each so disposed that the surfaces of the inclining disks adjacent to each other in the row face each other. In this configuration, the storing/feeding units 16*aa* to 16*ad* and 51*a* to 51*d* are so disposed that the orientation of the front surfaces (or rear surfaces) of the inclining disks differ in the right row from the orientation in the left row.

The configuration described above avoid the situation in which coins that drop into the storing/feeding units 16*aa* to 16*ad* and 51*a* to 51*d*, which are so disposed as to sandwich the transport unit 12, stack in the vicinity of the feeding exits, whereby the coin handling apparatus 1 can appropriately feed coins.

Further, since the coin handling apparatus 1 incorporates the storing/feeding units 16*aa* to 16*ad* and 51*a* to 51*d*, which are storing/feeding units of one type, the cost of manufacturing the coin handling apparatus 1 can be lowered.

Embodiment 3

Embodiment 3 differs from Embodiment 1 in terms of the disposition of the storing/feeding units. For example, in Embodiment 3, the front surfaces of storing/feeding units adjacent to each other face each other.

Figure 14:
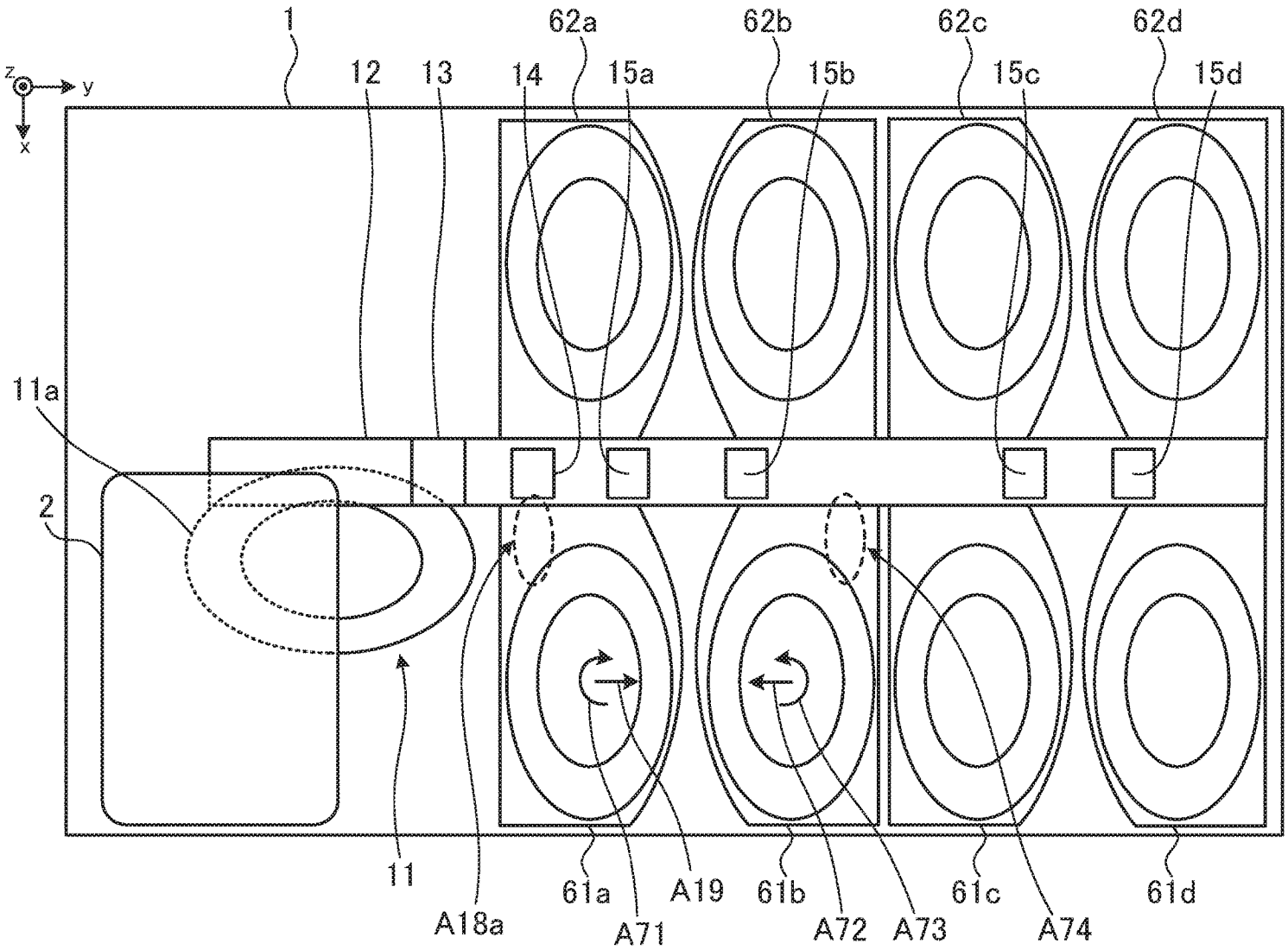
FIG. 14 is a plan view of a coin handling apparatus according to Embodiment 3.

FIG. 14 is a plan view of a coin handling apparatus 1 according to Embodiment 3. In FIG. 14, the same portions as those in FIG. 4 have the same reference characters. The coin handling apparatus 1 includes storing/feeding units 61*a* to 61*d* and storing/feeding units 62*a* to 62*d*, as shown in FIG. 14.

The storing/feeding unit 61*a* and the storing/feeding unit 61*b* are so disposed that the front surfaces of the inclining disks thereof face each other. For example, the storing/feeding unit 61*a* is so disposed that the front surface of the inclining disk faces the rear side of the apparatus (is oriented in +y-axis direction), and the storing/feeding unit 61*b* is so disposed that the front surface of the inclining disk faces the front side of the apparatus (is oriented in −y-axis direction).

The inclining disk of the storing/feeding unit 61*a* rotates around the axis indicated by the arrow A19 in FIG. 14. The storing/feeding unit 61*a*, when it feeds coins stored in the hopper to the feeding exit (see dotted-line frame A18*a* in FIG. 14, for example), rotates the inclining disk in the direction indicated by the arrow A71 in FIG. 14 (rotates inclining disk clockwise when viewed in +y-axis direction) to feed the stored coins.

The inclining disk of the storing/feeding unit 61*b* rotates around the axis indicated by the arrow A72 in FIG. 14. The storing/feeding unit 61*b*, when it feeds coins stored in the hopper to the feeding exit, rotates the inclining disk in the direction indicated by the arrow A73 in FIG. 14 (rotates inclining disk counterclockwise when viewed in −y-axis direction) to feed the stored coins. The dotted-line frame indicated by the arrow A74 in FIG. 14 represents the position of the coin feeding exit. The coins fed to the feeding exit drop onto the withdrawal transport unit 17 (not shown in FIG. 14).

The storing/feeding units 61*c* and 61*d* are so disposed that the front surfaces of the inclining disks thereof face each other, as are the storing/feeding units 61*a* and 61*b*. The storing/feeding units 62*a* and 62*b* are so disposed that the front surfaces of the inclining disks thereof face each other, as are the storing/feeding units 61*a* and 61*b*. The storing/feeding units 62*c* and 62*d* are so disposed that the front surfaces of the inclining disks thereof face each other, as are the storing/feeding units 61*a* and 61*b*.

As described above, the storing/feeding units 61*a* to 61*d* and 62*a* to 62*d* form a plurality of rows along the transport unit 12, and the rows are each so disposed that the surfaces of inclining disks adjacent to each other in the row face each other. In this configuration, the storing/feeding units 61*a* to 61*d* and 62*a* to 62*d* are so disposed that the front (rear) surfaces of inclining disks adjacent to each other face each other. The configuration described above avoids the situation in which coins that drop into the storing/feeding units 61*a* to 61*d* and 62*a* to 62*d*, which are so disposed as to sandwich the transport unit 12, stack in the vicinity of the feeding exits, whereby the coin handling apparatus 1 can appropriately feed coins.

The disposition of the storing/feeding units is not limited to those shown in the first to third embodiments. Variations of the disposition will be described below.

Figure 15:
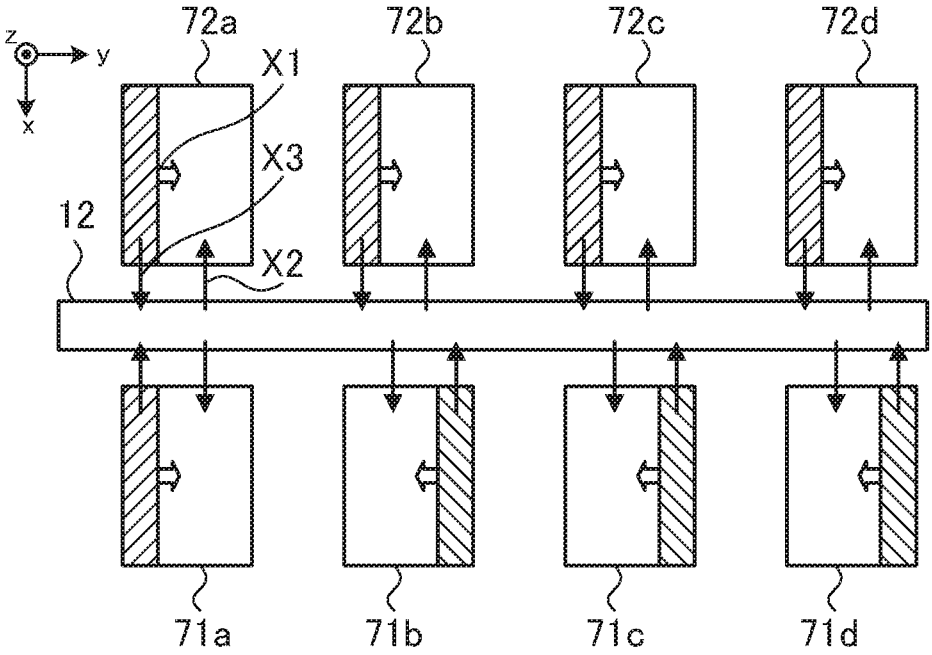
FIG. 15 shows a first example of the disposition of the storing/feeding units.

FIG. 15 shows a first example of the disposition of the storing/feeding units. FIG. 15 shows the transport unit 12 described in FIG. 4 and other figures and storing/feeding units 71*a* to 71*d* and 72*a* to 72*d*.

The open arrows extending from the hatched portions of the storing/feeding units 71*a* to 71*d* and 72*a* to 72*d* (X1 in FIG. 15, for example) represent the orientation of the front surfaces of the inclining disks. For example, the front surface of the inclining disk of the storing/feeding unit 71*a* is oriented in the +y-axis direction and corresponds, for example, to the disposition of the storing/feeding unit 61*a* shown in FIG. 14. The front surface of the inclining disk of the storing/feeding unit 71*b* is oriented in the −y-axis direction and corresponds, for example, to the disposition of the storing/feeding unit 61*b* shown in FIG. 14.

The arrows extending from the transport unit 12 toward the storing/feeding units 71*a* to 71*d* and 72*a* to 72*d* (X2 in FIG. 15, for example) represent the directions in which coins drop into (and are stored by) the storing/feeding units 71*a* to 71*d* and 72*a* to 72*d*. The arrows extending from the hatched portions of the storing/feeding units 71*a* to 71*d* and 72*a* to 72*d* toward the transport unit 12 (X3 in FIG. 15, for example) represent the directions in which coins are fed onto the withdrawal transport unit 17 (not shown in FIG. 15).

In the example shown in FIG. 15, in the right row out of the right and left rows, the storing/feeding units 71*a* and 71*b* are so disposed that the front surfaces of the inclining disks thereof face each other. In FIG. 14, the front surfaces of the inclining disks of storing/feeding units adjacent to each other face with each other both in the right and left rows. Instead, the front surfaces of the inclining disks of storing/feeding units adjacent to each other may face each other in one of the right and left rows of storing/feeding units, as shown in FIG. 15.

In the example shown in FIG. 15, the storing/feeding units 71*a* to 71*d* in the right row and the storing/feeding units 72*a* to 72*d* in the left row differ from each other in terms of the orientation of the front surface of the inclining disk. Therefore, even when coins are simultaneously fed from the storing/feeding units 71*b* to 71*d* in the right row and the storing/feeding units 72*b* to 72*d* in the left row onto the withdrawal transport unit 17, the coins do not collide with each other. On the other hand, when coins are simultaneously fed from the storing/feeding unit 71*a* in the right row and the storing/feeding unit 72*a* in the left row onto the withdrawal transport unit 17, the coins collide with each other. The storing/feeding unit 71*a* in the right row and the storing/feeding unit 72*a* in the left row are therefore configured to store coins of denominations that do not need to be fed at the same time. For example, the storing/feeding units 71*a* and 72*a* are configured to store coins of the same denomination. In this case, coins may be fed from one of the storing/feeding units 71*a* and 72*a*.

Figure 16:
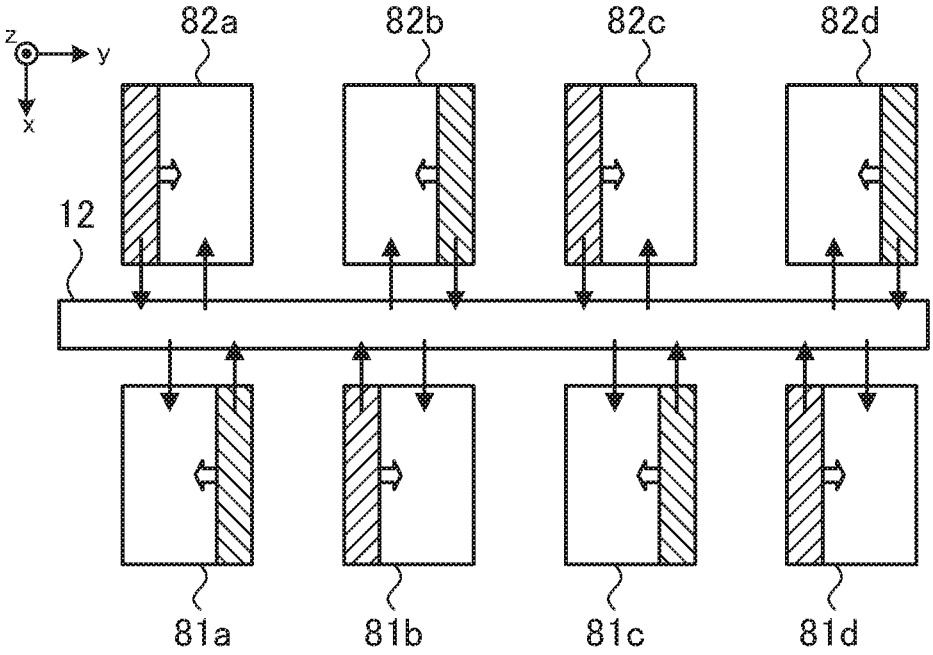
FIG. 16 shows a second example of the disposition of the storing/feeding units.

FIG. 16 shows a second example of the disposition of the storing/feeding units. In FIG. 16, a storing/feeding unit 81*a* and a storing/feeding unit 81*b* in the right row are so disposed that the rear surfaces of the inclining disks thereof face each other. Further, a storing/feeding unit 81*c* and a storing/feeding unit 81*d* in the right row are so disposed that the rear surfaces of the inclining disks thereof face each other.

On the other hand, a storing/feeding unit 82*a* and a storing/feeding unit 82*b* in the left row are so disposed that the front surfaces of the inclining disks thereof face each other. Further, a storing/feeding unit 82*c* and a storing/feeding unit 82*d* in the left row are so disposed that the front surfaces of the inclining disks thereof face each other.

That is, in FIG. 16, the storing/feeding units 81*a* and 81*b* differ from the storing/feeding units 82*a* and 82*b* in terms of the inclining disk faces facing each other. Similarly, the storing/feeding units 81*c* and 81*d* differ from the storing/feeding units 82*c* and 82*d* in terms of the inclining disk faces facing each other.

Therefore, even when coins are simultaneously fed from the storing/feeding units 81*a* to 81*d* in the right row and the storing/feeding units 82*a* to 82*d* in the left row, the coins do not collide with each other.

The direction in which each of the storing/feeding units is disposed are, of course, not limited to the those in the variations described above. For example, in FIG. 15, the front surfaces of the inclining disks of the storing/feeding units 71*c* and 71*d* may be oriented in the +y-axis direction. Further, in FIG. 16, the front surfaces of the inclining disks of the storing/feeding units 82*a* to 82*d* may all be oriented in the +y-axis direction.

Embodiment 4

In Embodiment 4, a coin handling apparatus 1 includes differently configured storing/feeding units mixed with one another. For example, the storing/feeding units in the right row differ from the storing/feeding units in the left row in terms of the thickness of the guide. Further, the storing/feeding units in the right row differ from the storing/feeding units in the left row in terms of the thickness of protruding members of the inclining disk that catch coins and the thickness of a coin circumferential edge holding unit of the inclining disk.

Figure 17:
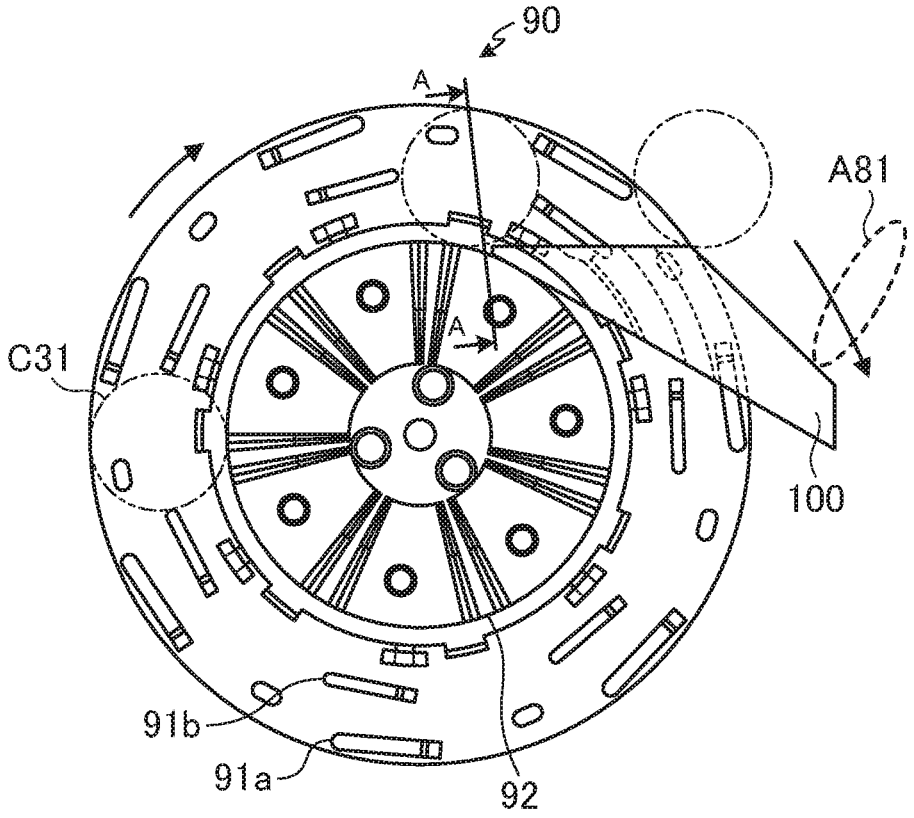
FIG. 17 shows part of an inclining disk of a storing/feeding unit according to Embodiment 4.

FIG. 17 shows part of the inclining disk of each of the storing/feeding units according to Embodiment 4. FIG. 17 shows an inclining disk 90 and a guide 100 of the storing/feeding unit. FIG. 17 further shows a coin C31 picked up by the inclining disk 90.

The inclining disk 90 and the guide 100 can be an inclining disk and a guide used in a typical storing/feeding unit. For example, the inclining disk 90 and the guide 100 can be the inclining disk and the guide disclosed in FIGS. 6 to 8 in Japanese Patent Application Laid-Open No. 2012-174035. It is, however, noted that the inclining disk 90 and the guide 100 partially differ from a typical inclining disk and guide (thicknesses thereof are set differently), as will be described below.

The inclining disk 90 includes protruding members 91*a* and 91*b*, which pick up the coins stored in the hopper (not shown) one by one, and a coin circumferential edge holding unit 92, which holds (supports) the circumferential edge of each of the picked-up coins.

The guide 100 is a plate-shaped member and is so disposed as to be slightly separate from the front surface of the inclining disk 90. Further, the guide 100 is so provided as to extend from the coin circumferential edge holding unit 92 to the feeding exit, via which coins are fed (portion indicated by dotted-line frame A81 in FIG. 17). Grooves (indicated by dotted lines) along which the protruding members 91*a* and 91*b* and other components on the inclining disk 90 travel are formed in the rear surface of the guide 100.

The coin C31 picked up by the inclining disk 90 mounts on the upper end of the guide 100. The coin C31 having mounted on the upper end of the guide 100 moves along the upper end of the guide 100 toward the feeding exit as the inclining disk 90 rotates, and the coin C31 is eventually separate from the inclining disk 90. The coin C31 is then fed via the feeding exit indicated by the dotted-line frame A81.

Figure 18:
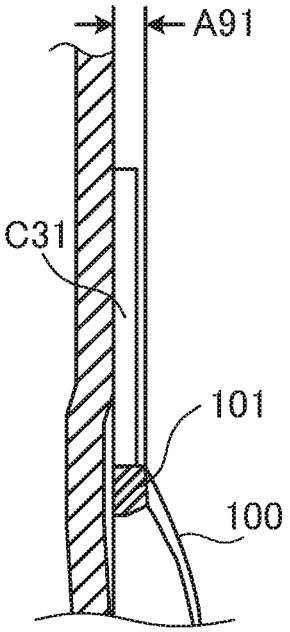
FIG. 18 is a cross-sectional view taken along the line A-A indicated by the arrows in FIG. 17.

FIG. 18 is a cross-sectional view taken along the line A-A indicated by the arrows in FIG. 17. In FIG. 18, the same portions as those in FIG. 17 have the same reference characters. A hatched portion 101 shown in FIG. 18 represents a front end portion of the guide 100.

The upper end of the guide 100 on which a coin mounts is a flat surface. The storing/feeding units in the right row and the storing/feeding units in the left row of the coin handling apparatus 1 differ from each other in terms of the thickness A91 of the upper end of the guide 100. More specifically, the storing/feeding units in the right row have the same thickness A91 of the upper end of the guide 100, and the storing/feeding units in the left row have the same thickness A91 of the upper end of the guide 100, but the thickness A91 in the storing/feeding units in the right row differs from the thickness A91 in the storing/feeding units in the left row.

The coin handling apparatus 1 can store coins of a variety of denominations. For example, the coin handling apparatus 1, which includes eight storing/feeding units as shown in FIG. 2, can store coins of eight denominations at the maximum.

In a case where the storing/feeding units are configured by using the guide 100 of one type, coins having a variety of thicknesses cannot be appropriately separate one by one from each of the inclining disk in some cases.

For example, in a case where there is a large difference in thickness between the thinnest coin and the thickest coin handled by the coin handling apparatus 1, the guides 100 cannot each appropriately separate the coins one by one from the inclining disk in some cases. Specifically, in a case where the thickness A91 of the guide 100 is set at the average of the thickness of the thinner coin and the thickness of the thickest coin, two or more thinnest coins, for example, could undesirably mount on the upper end of the guide 100. On the other hand, each of the thickest coins could partially extend off the upper end of the guide 100 and hence could not mount on (could fall off) the upper end of the guide 100.

To avoid the situation described above, the storing/feeding units of the coin handling apparatus 1 are so configured that the thickness of the guides 100 in the right row differs from that in the left row. Further, for example, coins each having a thickness smaller than or equal to a predetermined threshold are stored in the storing/feeding units in the right row, and coins each having a thickness greater than the predetermined threshold are stored in the storing/feeding units in the left row. That is, coins are classified into two groups in terms of thickness; the coins in the thinner group are stored in the storing/feeding units in the right row, and the coins in the thicker group are stored in the storing/feeding units in the left row.

Classifying coins to be stored in the storing/feeding units in the right row and coins to be stored in the storing/feeding units in the left row in terms of the thickness of a coin allows adjustment of the thickness A91 of the upper end of each of the guides 100 based on the thicknesses of the coins stored in the two rows. For example, the thickness A91 of the upper end of each of the guides 100 in the storing/feeding units in the right row is set at a value that allows one thinnest coin to be stored in any of the storing/feeding units in the right row to mount on the upper end of the guide 100 and prevents each thickest coin from falling off the upper end of the guide 100. Similarly, the thickness A91 of the upper end of each of the guides 100 in the storing/feeding units in the left row is set at a value that allows one thinnest coin to be stored in any of the storing/feeding units in the left row to mount on the upper end of the guide 100 and prevents each thickest coin from falling off the upper end of the guide 100.

The above description has been made of the case where coins in the thinner group are stored in the storing/feeding units in the right row and coins in the thicker group are stored in the storing/feeding units in the left row, but the coins in the thinner and thicker groups may, of course, be stored the other way around. That is, coins in the thinner group may be stored in the storing/feeding units in the left row, and coins in the thicker group may be stored in the storing/feeding units in the right row.

As described above, the storing/feeding units are so configured that the guides 100, which guide coins caught by the protruding members on the inclining disks 90 to the feeding exits, differ in terms of thickness between the right and left rows that sandwich the transport unit 12. The storing/feeding units in the coin handling apparatus 1 can therefore appropriately feed coins.

The protruding members 91*a* and 91*b* and the coin circumferential edge holding unit 92 may also differ in terms of thickness between the storing/feeding units in the right row and the storing/feeding units in the left row, as do the guides 100. The inclining disks 90 can each thus appropriately pick up coins (one by one) stored in the hopper.

REFERENCE SIGNS LIST

1 Coin handling apparatus
2 Inlet

3 Outlet
11 Accumulation feeder
11*a*, 90 Inclining disk
12 Transport unit
13 Identifying unit
14, 15*a* to 15*d*, 41*a* to 41*d*, 42*a* to 42*d* Coin diverter
16*aa* to 16*ad*, 16*ba* to 16*bd*, 51*a* to 51*d*, 61*a* to 61*d*, 62*a* to 62*d*, 71*a* to 71*d*, 72*a* to 72*d*, 81*a* to 81*d*, 82*a* to 82*d* Storing/feeding unit
17 Withdrawal transport unit
18 Collection box
21 A gate
22, 32 Actuator
23, 33 Linkage member
31 B gate
91*a*, 91*b* Protruding member
92 Coin circumferential edge holding unit
100 Guide

The invention claimed is:

1. A coin handling apparatus comprising:

a plurality of storing units, each of which comprising an inclining disk that is rotatable about an axis that is inclined by a predetermined angle with respect to a horizontal direction;

a deposit transport unit that transports coins and that diverts the transported coins in such a way that the transported coins are stored from the deposit transport unit to directly in any of the inclining disk of the plurality of storing units; and a withdrawal transport unit that transports coins fed from at least some of the plurality of storing units to an outlet, wherein the plurality of storing units are disposed to form a plurality of rows on right and left sides interposing the deposit transport unit and the withdrawal transport unit in a plane view, and each of the plurality of rows comprises two or more storing units, and the plurality of storing units are disposed so that surfaces of the inclining disks adjacent to each other in each of the plurality of rows face each other.

2. The coin handling apparatus according to claim 1, wherein at least two of the plurality of storing units adjacent to each other in one of the plurality of rows are disposed so that a front surface of the inclining disk of a first storing unit faces a rear surface of the inclining disk of a second storing units.

3. The coin handling apparatus according to claim 1, wherein at least one of the plurality of storing units includes a different configuration.

4. The coin handling apparatus according to claim 1, wherein at least one of the plurality of storing units includes the inclining disk that rotates in a different direction.

5. The coin handling apparatus according to claim 4, wherein the inclining disk in each of the plurality of storing units in a first row and the inclining disk in each of the plurality of storing units in a second row rotate in opposite directions.

6. The coin handling apparatus according to claim 1, wherein the plurality of storing units adjacent to each other on the right and left sides interposing the deposit transport unit and the withdrawal transport unit in the plane view are disposed so that feeding exits via which the coins are fed onto the withdrawal transport unit, are facing each other with the withdrawal transport unit positioned in between the feeding exits,

7. The coin handling apparatus according to claim 6, further comprising a controller that controls the plurality of adjacent storing units disposed to form a plurality of rows on the right and left sides interposing the deposit transport unit and the withdrawal transport unit in the plan view, the controller controlling the storing units not to simultaneously feed the coins onto the withdrawal transport unit.

8. The coin handling apparatus according to claim 7, wherein the controller controls the two or more storing units in one of the rows to simultaneously feed the coins onto the withdrawal transport unit.

9. The coin handling apparatus according to claim 1, further comprising:

a plurality of left-row diverters that are provided in correspondence with the plurality of storing units in the row on the left side and that divert deposited coins transported by the deposit transport unit in such a way that the deposited coins are stored in the plurality of storing units, and a plurality of right-row diverters that are provided in correspondence with the plurality of storing units in the row on the right side and that divert the deposited coins in such a way that the coins are stored in the plurality of storing units;

wherein, in the plurality of storing units adjacent to each other on the right and left sides, the left-row diverter that diverts the deposited coins to the storing unit on the left side, and the right-row diverter that diverts the deposited coins to the storing unit on the right side are disposed along a straight line.

10. The coin handling apparatus according to claim 1, further comprising a diverter that is formed of one module and diverts the coins transported by the deposit transport unit to the plurality of storing units adjacent to each other on the right and left sides of the deposit transport unit and the withdrawal transport unit.

11. The coin handling apparatus according to claim 1, wherein the plurality of adjacent storing units on the right and left sides interposing the deposit transport unit and the withdrawal transport unit are disposed so that feeding exits via which the coins are fed onto the withdrawal transport unit do not face the deposit transport unit and the withdrawal transport unit positioned between the feeding exits.

12. The coin handling apparatus according to claim 11, further comprising a controller that controls the plurality of adjacent storing units disposed to form a plurality of rows on the right and left sides interposing the deposit transport unit and the withdrawal transport unit, the controller controlling the storing units to simultaneously feed the coins onto the withdrawal transport unit.

13. The coin handling apparatus according to claim 1, wherein at least a set of the plurality of storing units adjacent to each other in one of the rows are disposed so that front surfaces of or rear surfaces of the inclining disks face each other.

14. The coin handling apparatus according to claim 13, wherein in one of the rows, two of the plurality of storing units in which the front surfaces of the inclining disks face each other and two of the plurality of storing units in which the rear surfaces of the inclining disks face each other are alternately disposed.

15. The coin handling apparatus according to claim 1, wherein the plurality of storing units each include a guide that guides the coins caught by a protruding member on the inclining disk to a feeding exit, and thicknesses of the guides in the rows on the right and left sides interposing the deposit transport unit and the withdrawal transport unit differ from each other.

16. The coin handling apparatus according to claim 1, wherein the plurality of storing units each include a protruding member that is provided on the inclining disk and that catches the coins, and thicknesses of the protruding members in the rows on the right and left sides interposing the deposit transport unit and the withdrawal transport unit differ from each other.

17. A coin handling apparatus, comprising:

a plurality of storing units, each of which comprising an inclining disk that is rotatable about an axis that is inclined by a predetermined angle with respect to a horizontal direction; and a deposit transport unit that transports coins and that diverts the transported coins in such a way that the transported coins are stored from the deposit transport unit to directly in any of the inclining disk of the plurality of storing units, wherein the plurality of storing units are disposed to form a plurality of rows along the deposit transport unit, and each of the plurality of rows comprises two or more storing units, and the plurality of storing units are disposed so that surfaces of the inclining disks adjacent to each other in each of the plurality of rows face each other, characterized in that a shift along a transport direction of the coins by the deposit transport unit exists between a position where the coins are dropped from the deposit transport unit into the storing unit and a position where the coins are fed from the storing unit.

* * * * *